US007695154B2

(12) United States Patent
Ellenburg et al.

(10) Patent No.: US 7,695,154 B2
(45) Date of Patent: Apr. 13, 2010

(54) ILLUMINATING FOOTWEAR ACCESSORY

(75) Inventors: Barbara Kay Ellenburg, Boulder, CO (US); Parker Stephen Ellenburg, Boulder, CO (US); Howard Steve Ellenburg, Boulder, CO (US)

(73) Assignee: DPM Associates, LLC, Boulder, CO (US)

( * ) Notice: Subject to any disclaimer, the term of this patent is extended or adjusted under 35 U.S.C. 154(b) by 37 days.

(21) Appl. No.: 12/098,738

(22) Filed: Apr. 7, 2008

(65) Prior Publication Data

US 2008/0253108 A1 Oct. 16, 2008

Related U.S. Application Data

(60) Provisional application No. 60/950,501, filed on Jul. 18, 2007, provisional application No. 60/910,392, filed on Apr. 5, 2007.

(51) Int. Cl.
*F21V 21/08* (2006.01)
*F21V 23/04* (2006.01)
*F21L 4/04* (2006.01)

(52) U.S. Cl. ..... 362/103; 362/457; 362/205; 362/394

(58) Field of Classification Search ..... 362/103, 362/267, 800, 457, 205, 394
See application file for complete search history.

(56) References Cited

U.S. PATENT DOCUMENTS

| | | | | |
|---|---|---|---|---|
| 5,465,197 | A * | 11/1995 | Chien | 362/202 |
| 5,934,784 | A * | 8/1999 | Dion | 362/103 |
| 6,474,830 | B1 * | 11/2002 | Hansen | 362/103 |
| 2006/0007668 | A1 * | 1/2006 | Chien | 362/103 |
| 2009/0091921 | A1 * | 4/2009 | Yang | 362/103 |

* cited by examiner

*Primary Examiner*—Jacob Y Choi
(74) *Attorney, Agent, or Firm*—Townsend and Townsend and Crew LLP

(57) ABSTRACT

A customized light module comprising is provided according to one embodiment of this disclosure. The customized light module, according to this embodiment, includes a housing, a light source, a removable decorative cap and a battery. The housing includes a stem configured to secure the customized light module within an aperture of an article of footwear. The light source is coupled with the housing. The decorative cap may be removably coupled with the housing and may be configured to illuminate when the light source is illuminates. The battery may be accessibly secured within the housing with a two-stage mechanism. The two-stage mechanism, for example, may include a child lock. In some embodiments, the housing has at least two configurations: a first configuration and a second configuration. A circuit is created between the battery and the light source in the first configuration and closed in the second configuration.

16 Claims, 35 Drawing Sheets

Wave washer with tabs
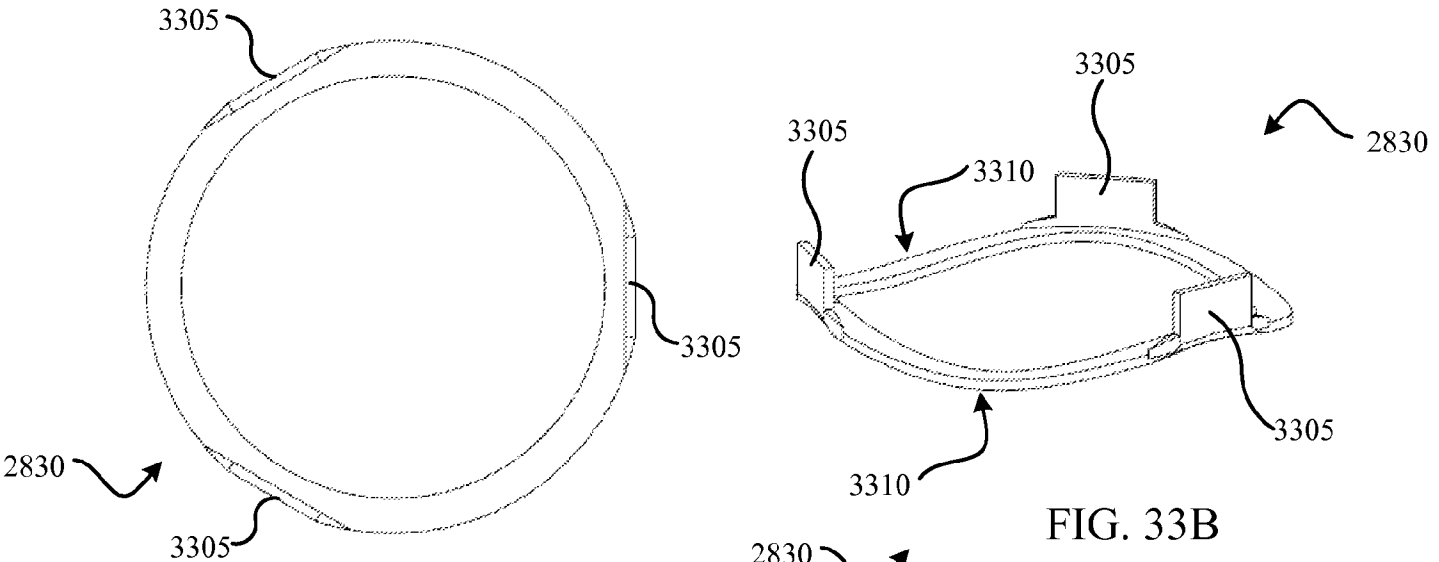
FIG. 33A
FIG. 33B
FIG. 33C
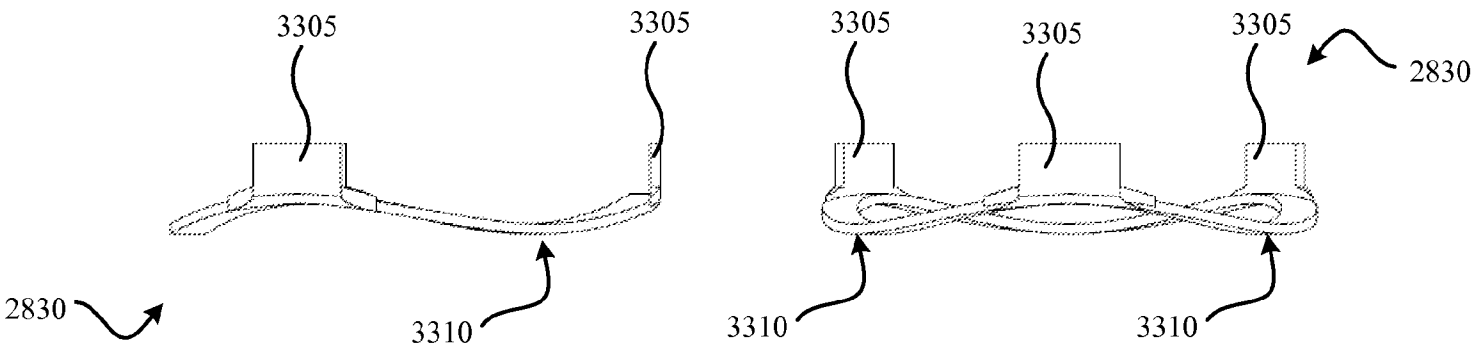
FIG. 33D

ILLUMINATING FOOTWEAR ACCESSORY

CROSS-REFERENCES TO RELATED APPLICATIONS

This application is a non-provisional, and claims the benefit, of commonly assigned U.S. Provisional Application No. 60/910,392, filed Apr. 5, 2007, entitled "Illuminating Footwear Accessory," and of U.S. Provisional Application No. 60/950,501, filed Jul. 18, 2007, entitled "Illuminating Footwear Accessory," the entirety of each of which is herein incorporated by reference for all purposes.

BACKGROUND OF THE INVENTION

For a number of years articles of footwear and various items of clothing have been sold with decorative attachments. These attachments have either been lighted and non removable or removable and non lighted, neither of which have had the ability to be both lighted and removable or to be further customized by the wearer and activate or deactivated at will.

BRIEF SUMMARY OF THE INVENTION

An illuminating footwear accessory is disclosed according to one embodiment. For example, the illuminating footwear accessory may be coupled to an outsole, an upper, a lace, a Velcro strap and/or any other footwear closure apparatus. In various embodiments, the illuminating footwear accessory may include a decorative outer housing. In some embodiments the illuminating footwear accessory may also be interchangeable. The illuminating footwear accessory may include, for example, an LED. The illuminating footwear accessory may also include, according to embodiments of the invention, an outer housing that may aid in securing the illuminating footwear accessory in an existing opening in a piece of footwear. The illuminating footwear accessory may also include an upper outer housing and a lower outer housing that are removably coupled together with frictional or rotational interlocking thread elements to secure the two housings.

According to another embodiment, the illumination source may include an LED, electroluminescence material, an incandescent light source, a chemoluminescence material, a fluorescence material, or any other illuminating or light emitting material and/or apparatus.

A U-shaped clasp member is also disclosed according to another embodiment. The U-shaped clasp member may be elongated. The U-shaped clasp member may include at least one hole at an end of the U that may be coupled to an outsole, an upper, a lace, a Velcro strap and/or any other footwear closure apparatus. The U-shaped clasp member may also be coupled with an illuminating footwear accessory while being secured to a piece of footwear.

One embodiment of the present disclosure relates to the customization and decoration of articles of footwear and/or other articles of clothing. More particularly and without limitation, the invention relates to a shoe, having one or more light sources affixed in novel ways. In one embodiment, the light fixture may be affixed on the outsole and/or upper of the shoe. The invention also relates to attachable/detachable illuminating footwear articles. The light source may also be affixed to laces and/or Velcro and/or other closure methods. The light source may be operative to directing light through interchangeable and removable decoratively designed attachments that glow. The light sources may include an LED.

BRIEF DESCRIPTION OF THE DRAWINGS

The structure, operation and advantages of the presently preferred embodiment of this invention will become further apparent upon consideration of the following description, taken in conjunction with the accompanying drawings, wherein:

FIGS. 33A, 33B, 33C and 33D show views of a wave washer according to one embodiment.

DETAILED DESCRIPTION OF THE INVENTION

Figure 1:
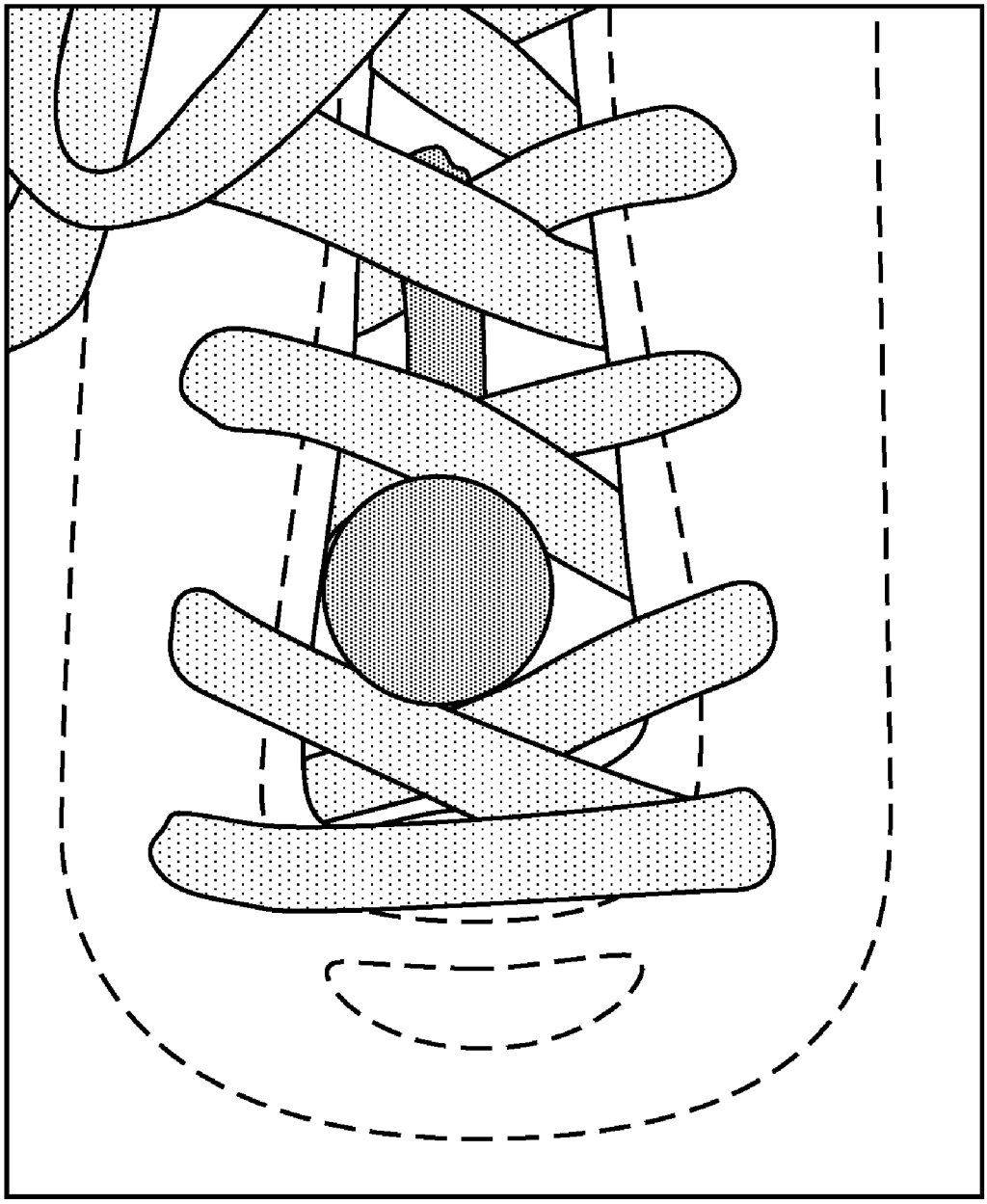
FIGS. 1 and 2 show an illuminating footwear accessory affixed to shoe laces according to one embodiment.
Figure 2:
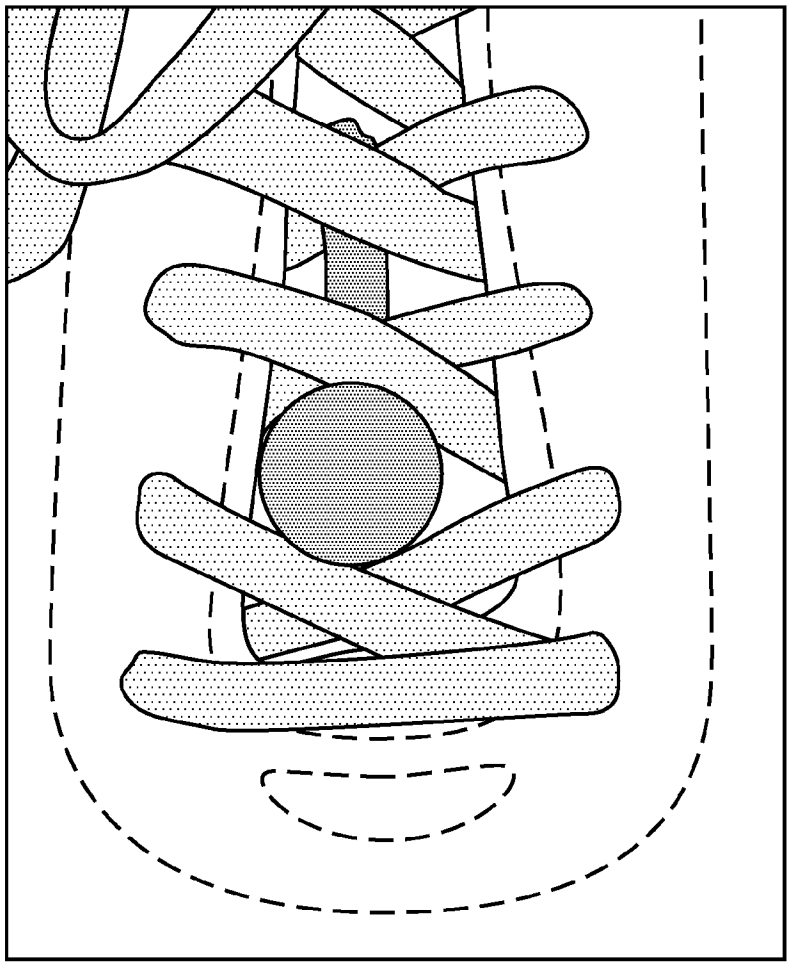
Figure 3A:
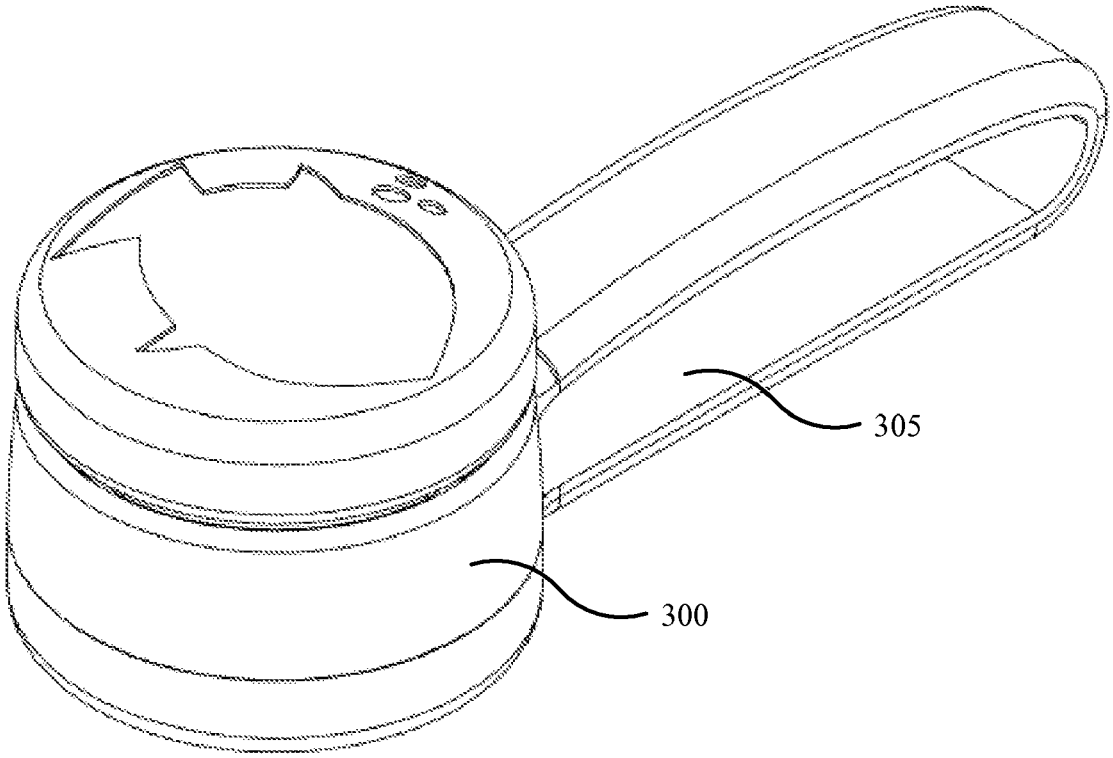
FIG. 3A shows an illuminating footwear accessory coupled with a U-shaped clasp member according to another embodiment.

FIGS. 1 and 2 show an illuminating footwear accessory affixed to shoe laces according to one embodiment. In one embodiment, the illuminating footwear accessory is coupled with a U-shaped clasp that secures the illuminating footwear accessory to the shoe laces. An exemplary U-shaped 305 clasp is shown in FIG. 3A attached with an illuminating footwear accessory 310.

Figure 3B:
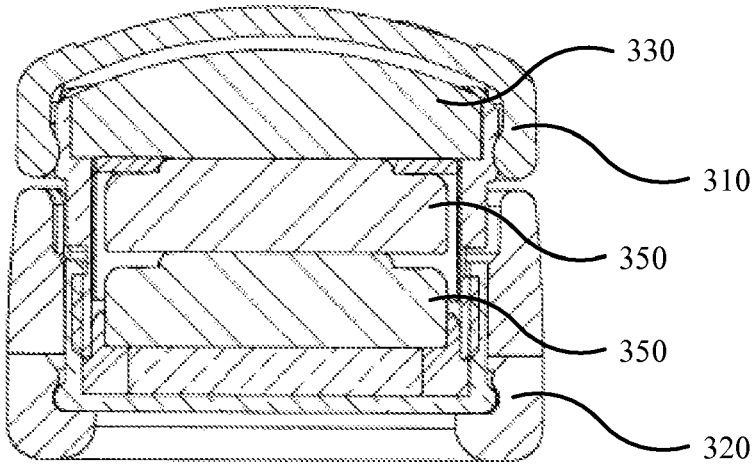
FIG. 3B shows a side view of the illuminating footwear accessory of FIG. 3A according to one embodiment.
Figure 4:
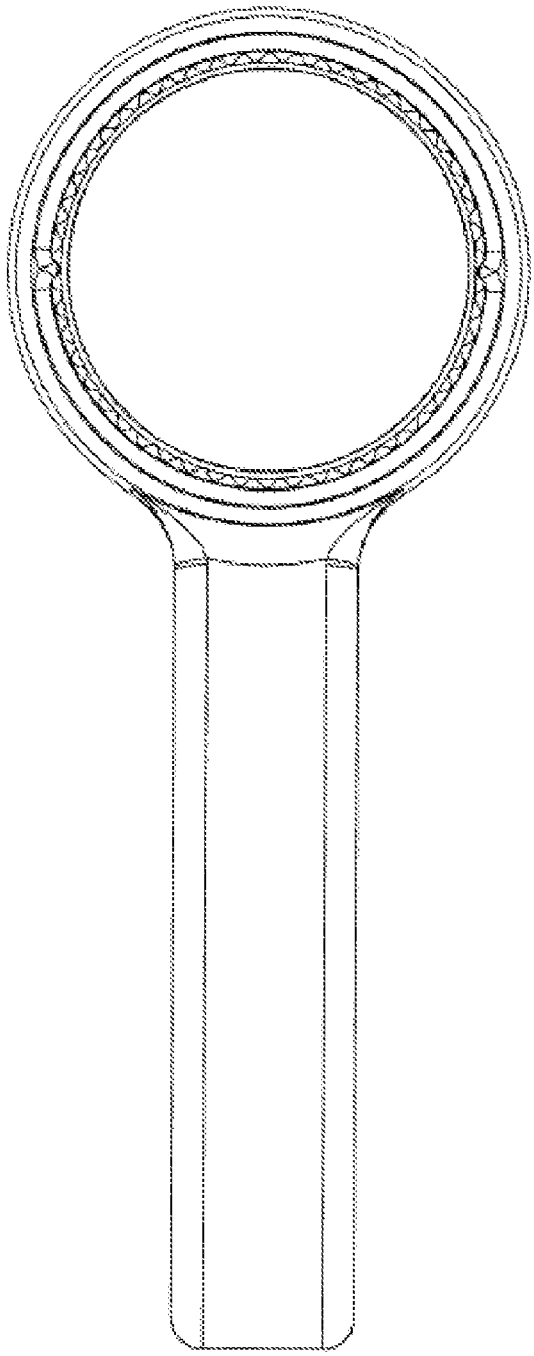
FIG. 4 shows a top view of a U-shaped clasp member according to another embodiment.

FIG. 3B shows a side view of the illuminating footwear accessory according to one embodiment. An upper housing 310 and lower housing 320 is shown. Two batteries 350 are used. An LED 330 is included. The LED 330 is powered by the batteries 350. The upper housing 310 and lower housing 320 may include a rotational or pressure switch. FIG. 4 shows a top view of a U-shaped clasp according to another embodiment.

Figure 5A:
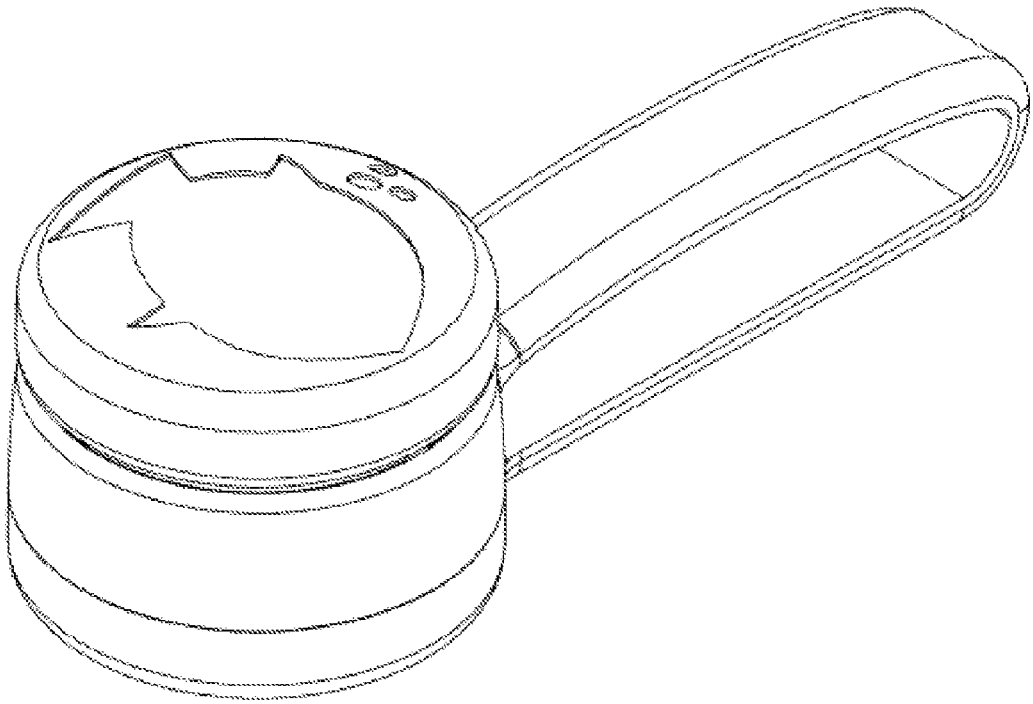
FIG. 5A shows an illuminating footwear accessory coupled with a U-shaped clasp member according to another embodiment.
Figure 5B:
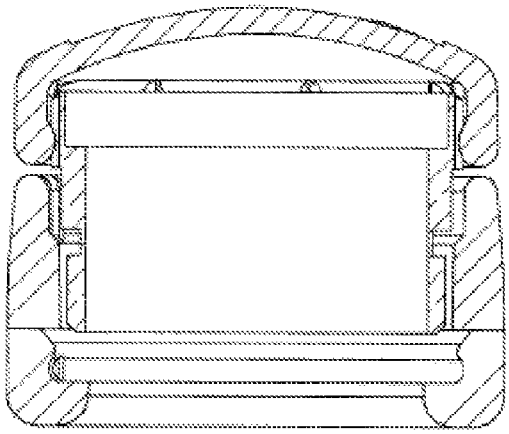
FIG. 5B shows a side view of the illuminating footwear accessory of FIG. 5A according to one embodiment.
Figure 5C:
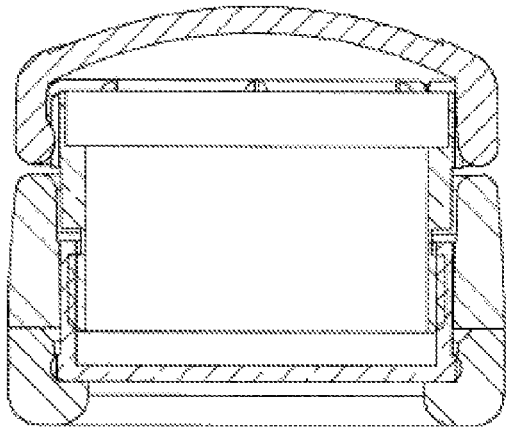
FIG. 5C shows a side view of the illuminating footwear accessory of FIG. 5A according to one embodiment.

FIG. 5A shows an illuminating footwear accessory coupled with a U-shaped clasp member with a fish shaped decorative cap according to another embodiment. FIGS. 5B and 5C show side views of illuminating footwear accessories according to two embodiments of the invention.

Figure 6:
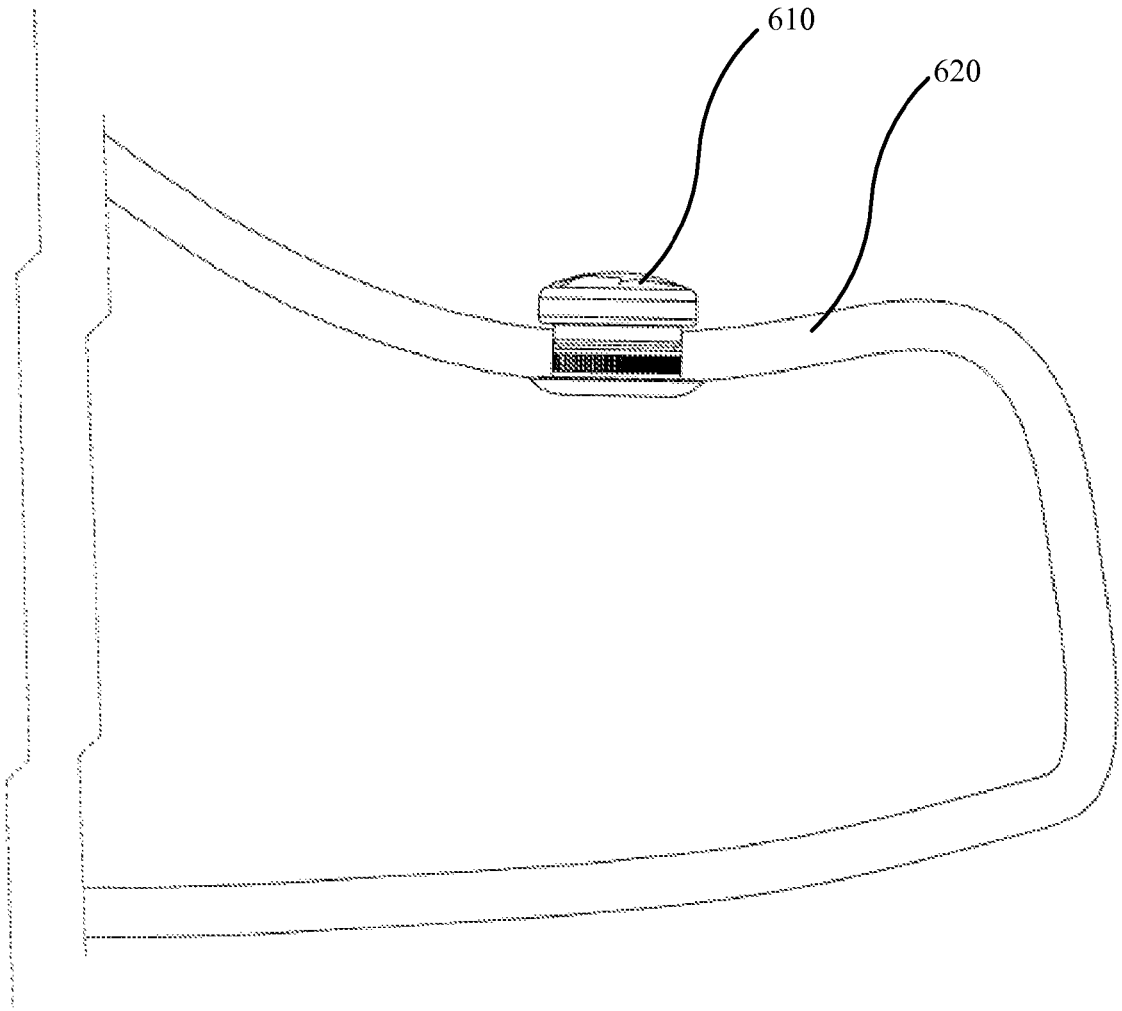
FIG. 6 shows a side view of an illuminating footwear accessory secured in a shoe through a hole in the shoe according to one embodiment.

FIG. 6 shows a side view of an illuminating footwear accessory 610 secured in a piece of footwear 620 through a hole in the shoe according to one embodiment. The piece of footwear 620 may include a shoe, a boot, a sandal, a clog, etc. The illuminating footwear accessory 610 includes a flange on the top and bottom of the housing that are used to secure the illuminating footwear accessory 610 to the piece of footwear 620.

Figure 7A:
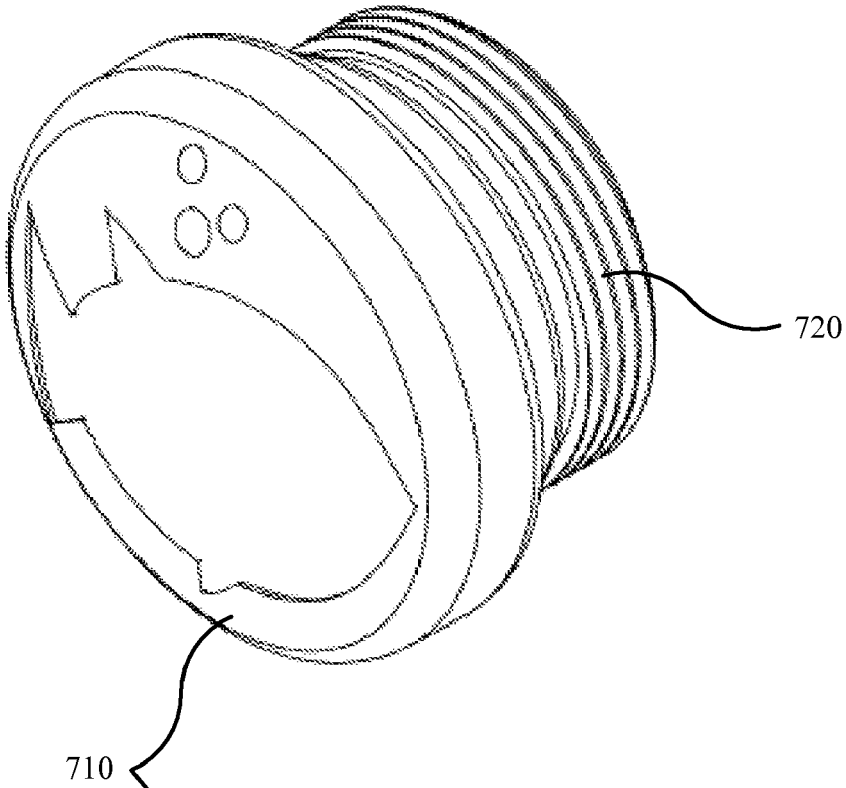
FIGS. 7A and 7B show interchangeable upper housings with a decorative cap for an illuminating footwear accessory according to one embodiment.
Figure 7B:
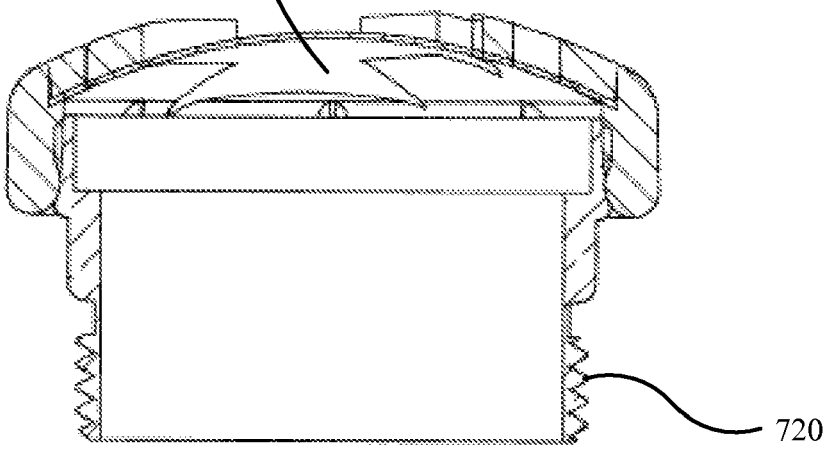

FIGS. 7A and 7B show interchangeable upper housings with a decorative cap 710 for an illuminating footwear accessory according to one embodiment. The upper housings include a threaded portion 720 adapted to secure to a lower portion. The thread portion may include a rubber, plastic, nylon or other material that is used to provide friction when threading the upper portion to the lower portion.

Figure 8:
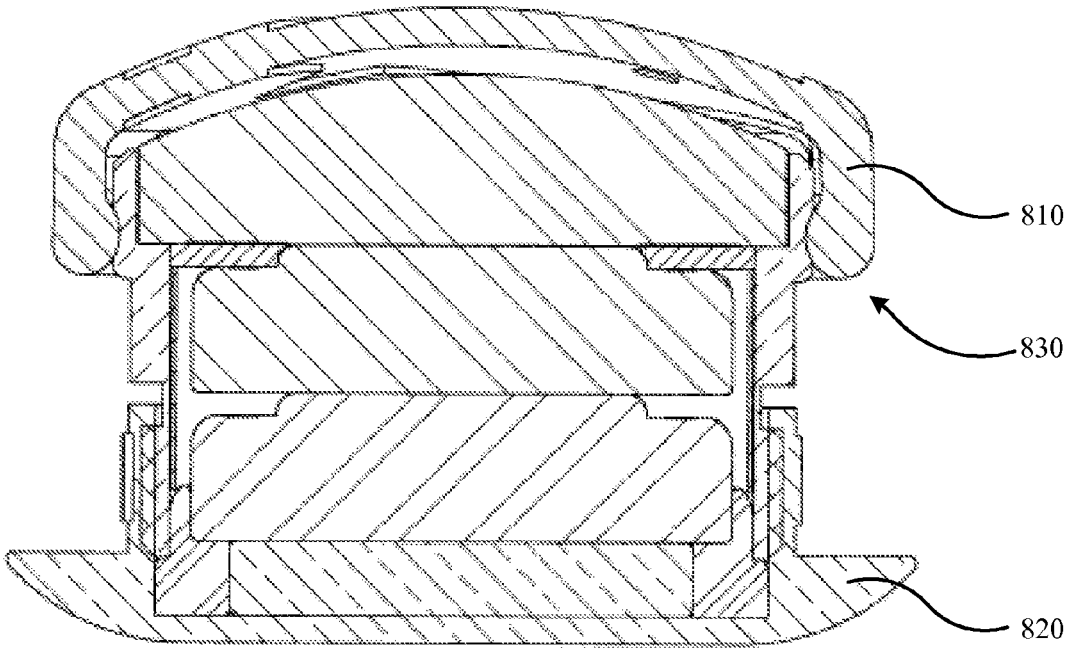
FIG. 8 shows an illuminating footwear accessory with a decorative upper housing and a flanged lower housing according to one embodiment.

FIG. 8 shows an illuminating footwear accessory with a decorative upper housing 810 and a flanged lower housing 820 according to one embodiment. The upper housing in this embodiment, also includes a extended portion 830 that extends past the base of the housing. The flange on the lower housing 820 and the extended portion 830 on the upper housing may be used to secure the illuminating footwear accessory in a hole within a piece of footwear. When the upper housing 810 and lower housing 820 are connected through the hole, the flange and the extended portion 830, hold the illuminating footwear accessory in place.

Figure 9A:
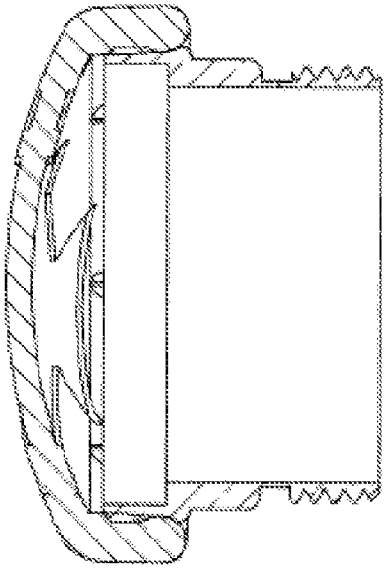
FIGS. 9A, 9B and 9C show an upper housing of an illuminating footwear accessory according to one embodiment.
Figure 9B:
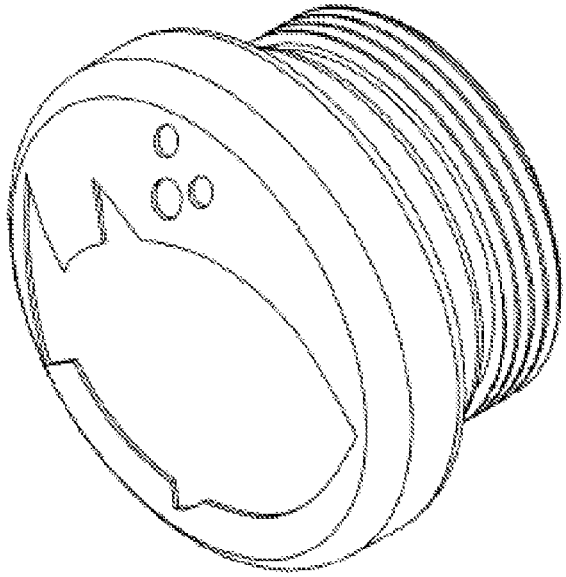
Figure 9C:
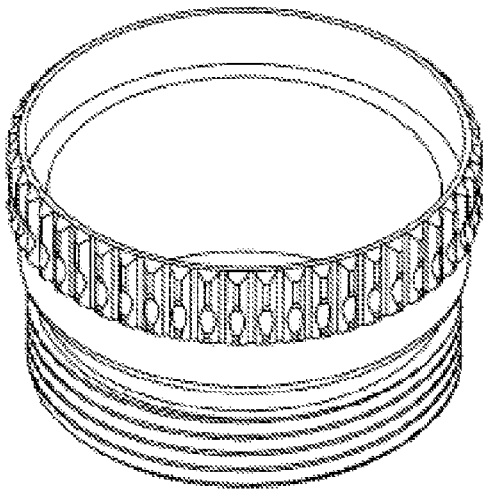

FIGS. 9A, 9B and 9C show various views of an upper housing of an illuminating footwear accessory according to one embodiment. FIG. 9C, in particular, shows an upper housing without the decorative cap. The decorative cap may be removable. The decorative cap may also be used with a non-light emitting accessory. For example, the decorative cap may be placed on a stem of decorative clothing article that is used on a shoe. Moreover, decorative caps may be produced in bulk and used for both light emitting and non-light emitting clothing accessories.

Figure 10:
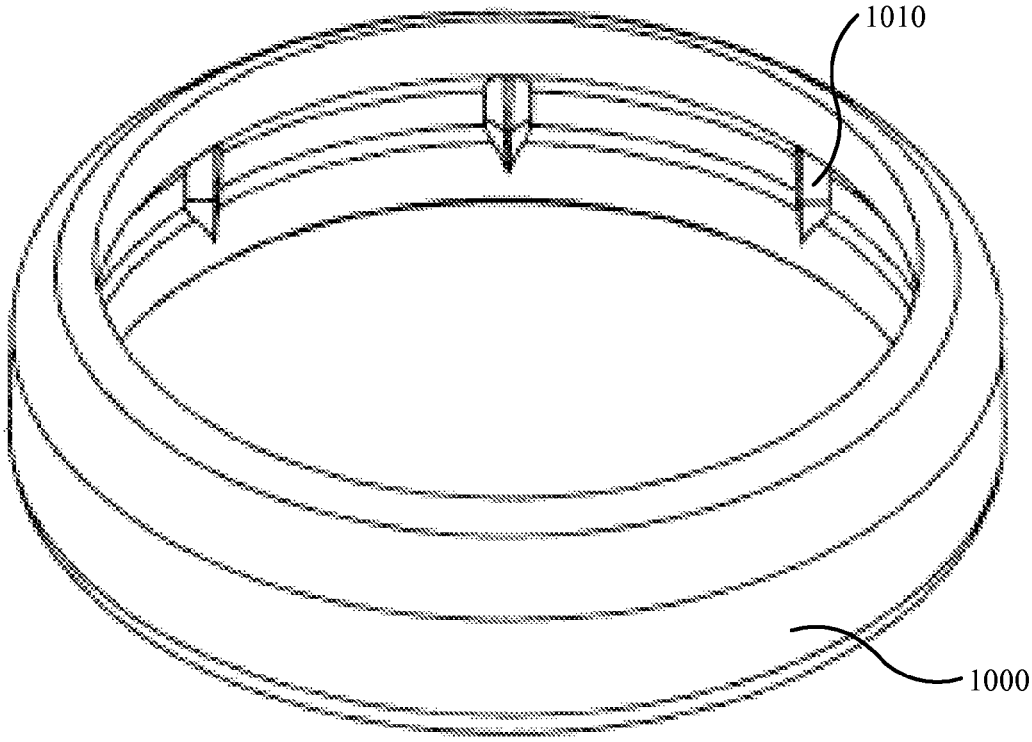
FIG. 10 shows a frictional member with detents according to one embodiment.

FIG. 10 shows a frictional member 1000 with detents 1010 according to one embodiment.

Figure 11:
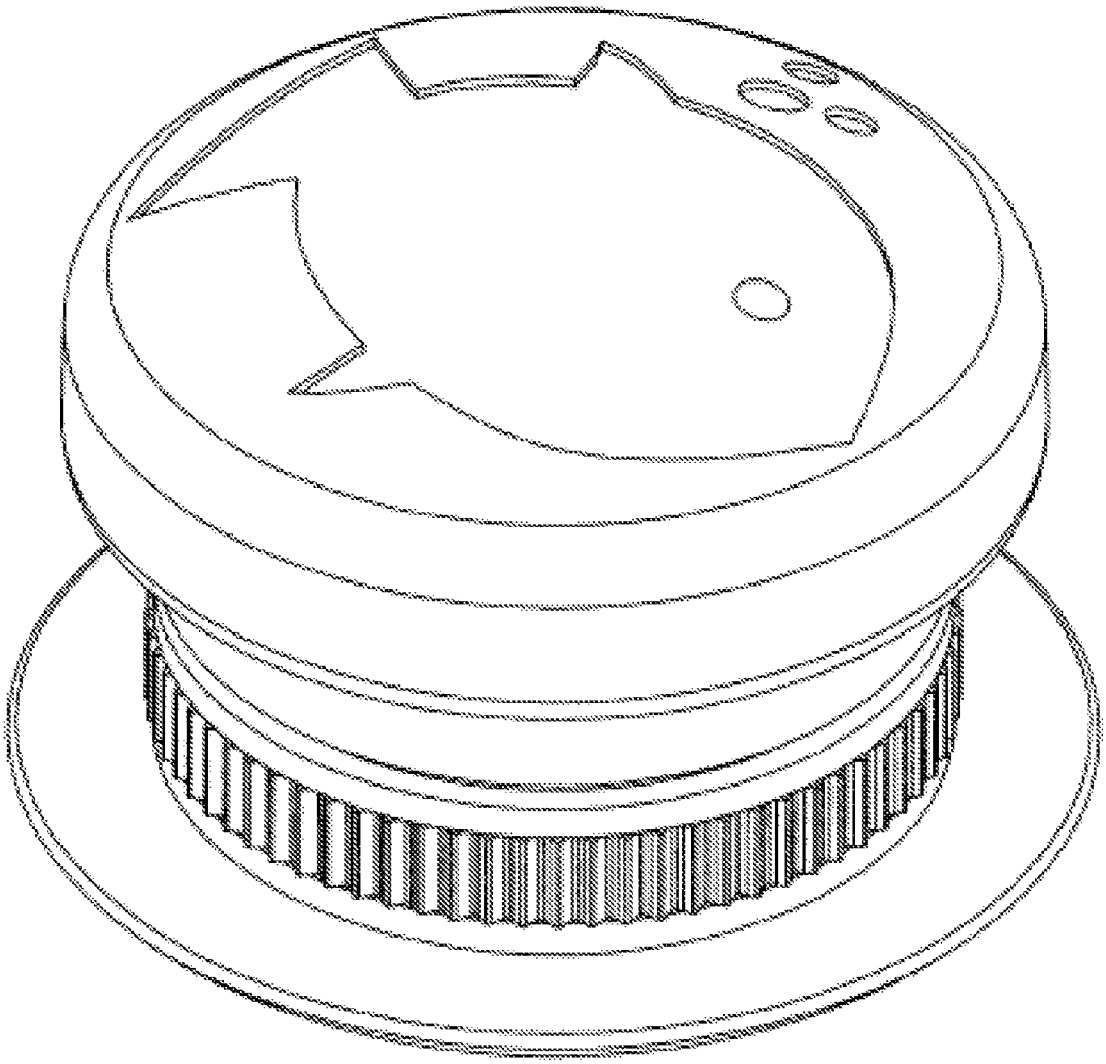
FIG. 11 shows a perspective view of an illuminating footwear accessory with a decorative upper housing and a flanged lower housing.

FIG. 11 shows a perspective view of an illuminating footwear accessory with a decorative upper housing and a flanged lower housing. The lower housing also has fictional detents on the outer surface. These surface detents may provide friction against a piece of footwear when the illuminating footwear accessory is placed within a hole in the footwear. In such a case, the friction placed on the lower housing of the illuminating footwear accessory may allow a user to rotate the upper portion of the housing relative to the lower portion of the housing causing the illumination source to illuminate when a rotationally activated switch is used.

The upper housing and the lower housing may include a cavity that includes one or more batteries according to one embodiment. When the upper and lower housings may comprise a switch that activates the illumination source by rotating the upper and lower housing relative to one another. In other embodiments, the upper and lower housings may be coupled with a snapping method that may allow the user to press the upper housing into the lower housing to activate the illumination source.

Figure 12A:
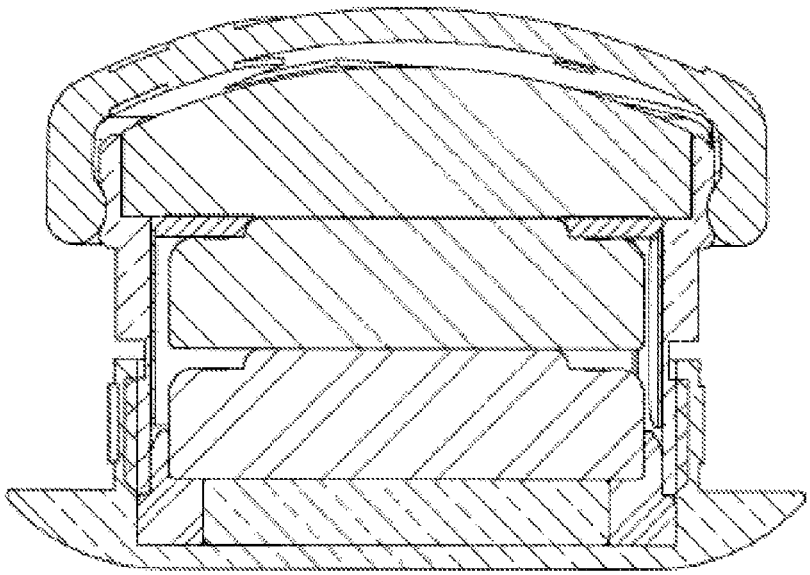
FIGS. 12A and 12B show a perspective view and a side view of an illuminating footwear accessory with a decorative upper housing and a flanged lower housing.
Figure 12B:
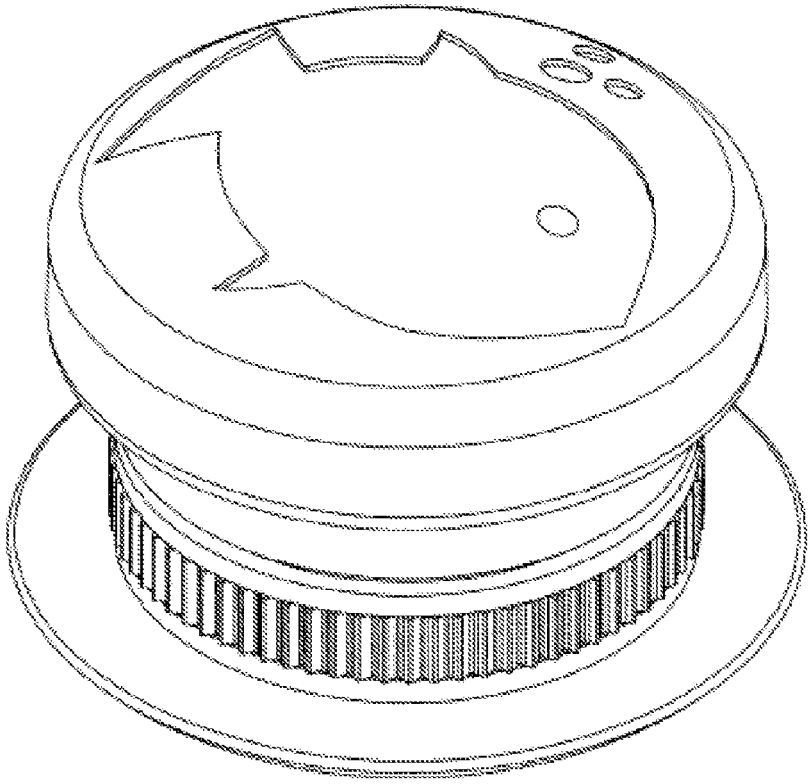
Figure 13A:
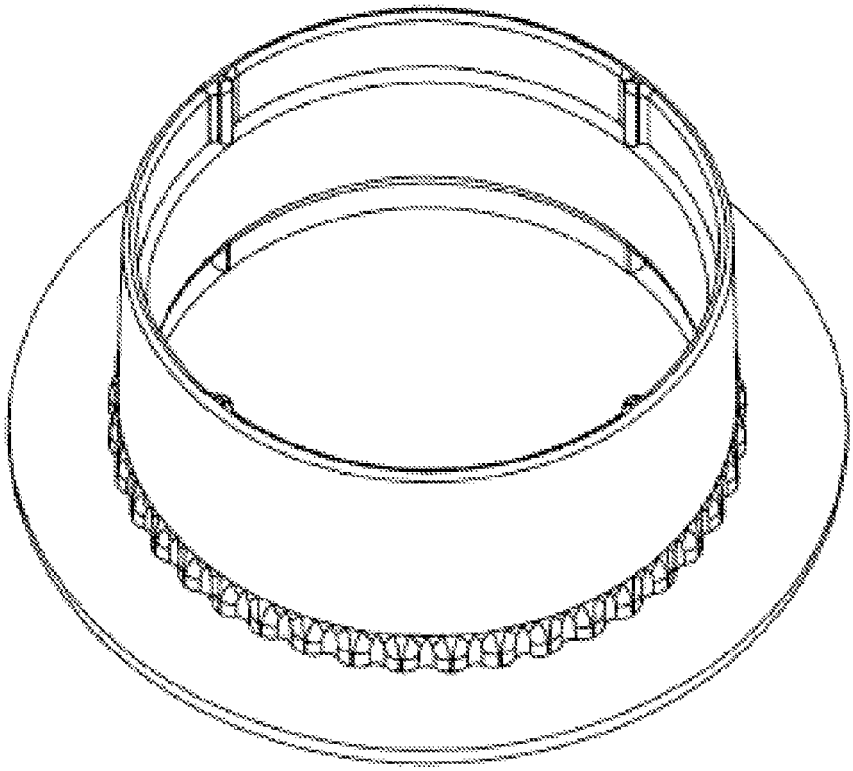
FIG. 13A shows a perspective view of a flanged lower housing of an illuminating footwear accessory according to one embodiment.
Figure 13B:
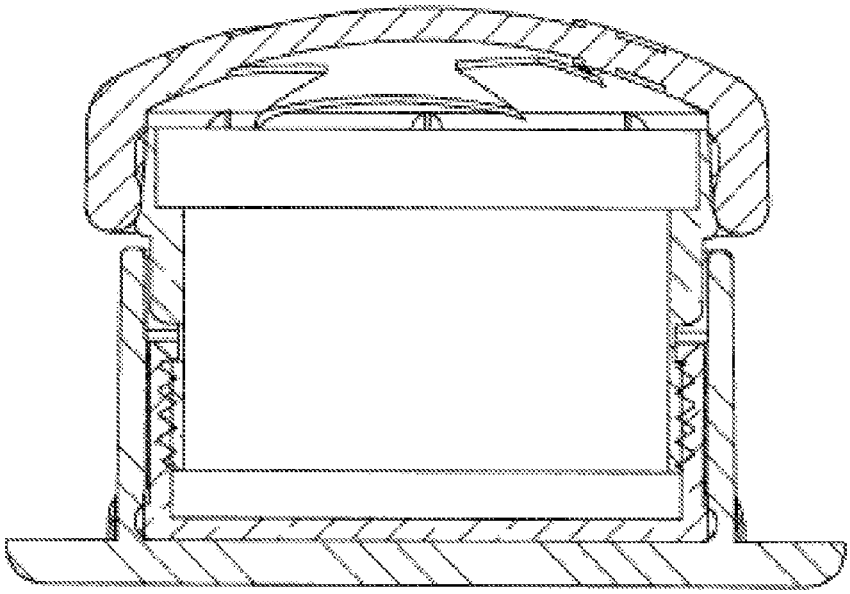
FIG. 13B shows a side view of an illuminating footwear accessory according to one embodiment.

FIGS. 12A and 12B show a perspective view and a side view of an illuminating footwear accessory with a decorative upper housing and a flanged lower housing. FIG. 13A shows a perspective view of a flanged lower housing of an illuminating footwear accessory according to one embodiment. FIG. 13B shows a side view of an illuminating footwear accessory according to one embodiment.

Figure 14:
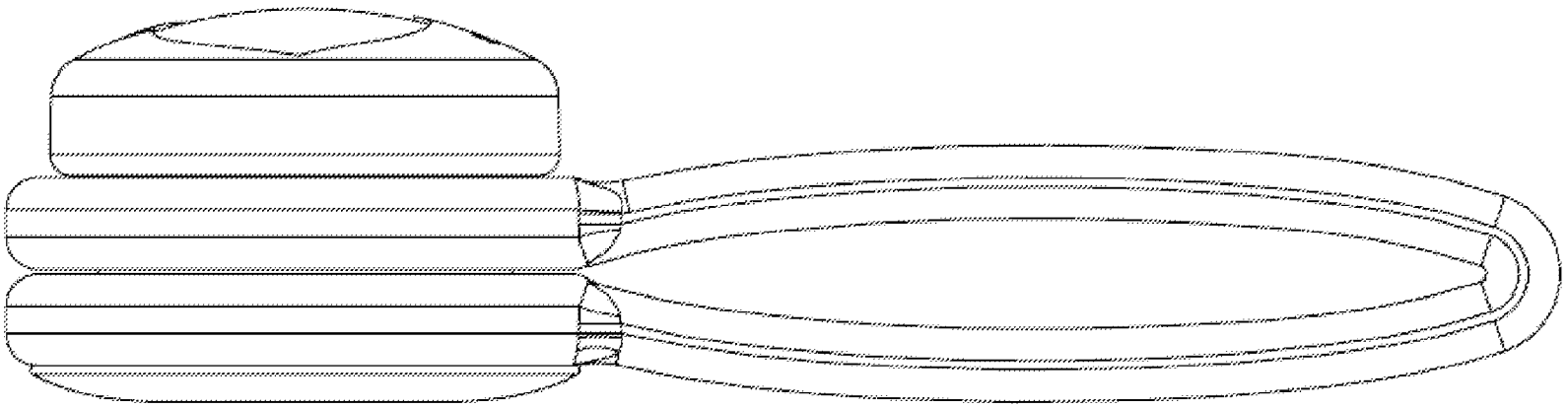
FIGS. 14 and 15 show an illuminating footwear accessory with loop-clip according to another embodiment.
Figure 15:
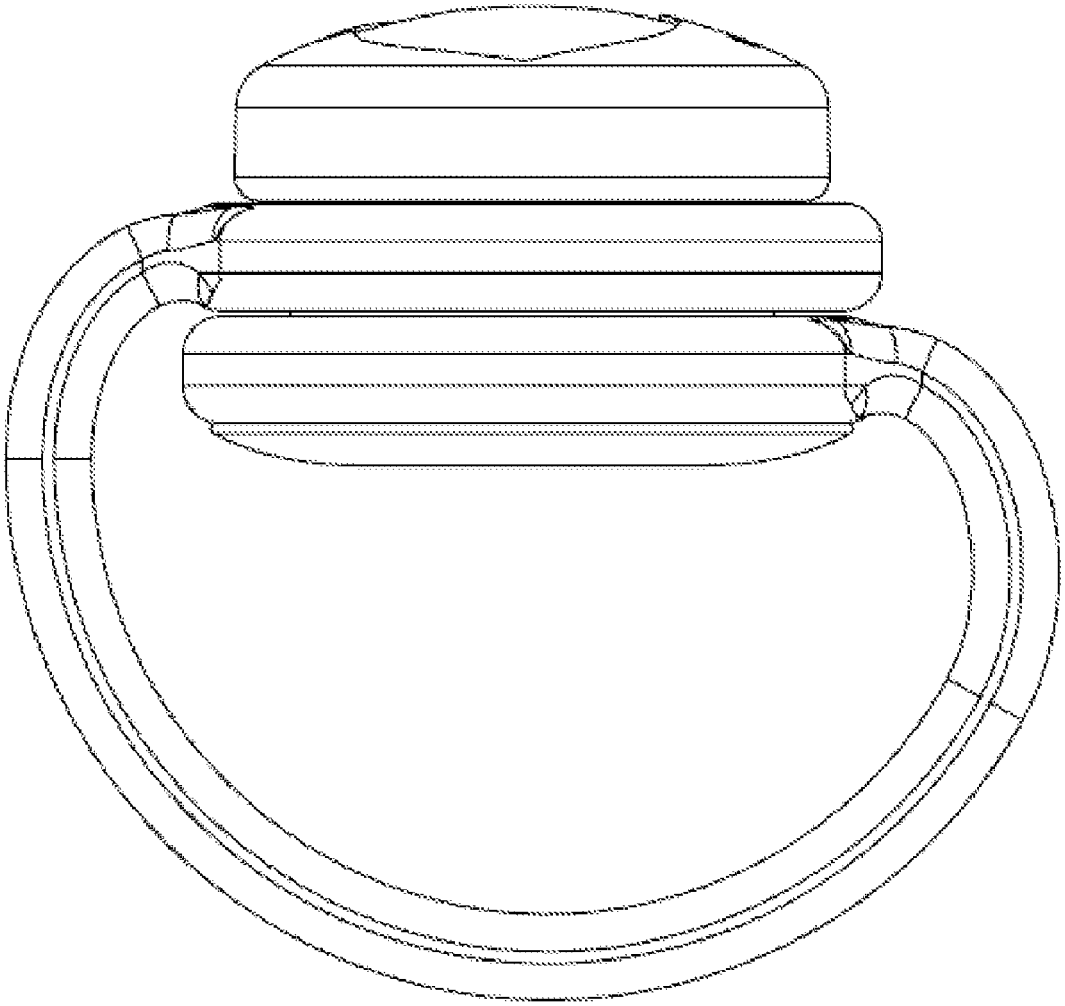
Figure 16:
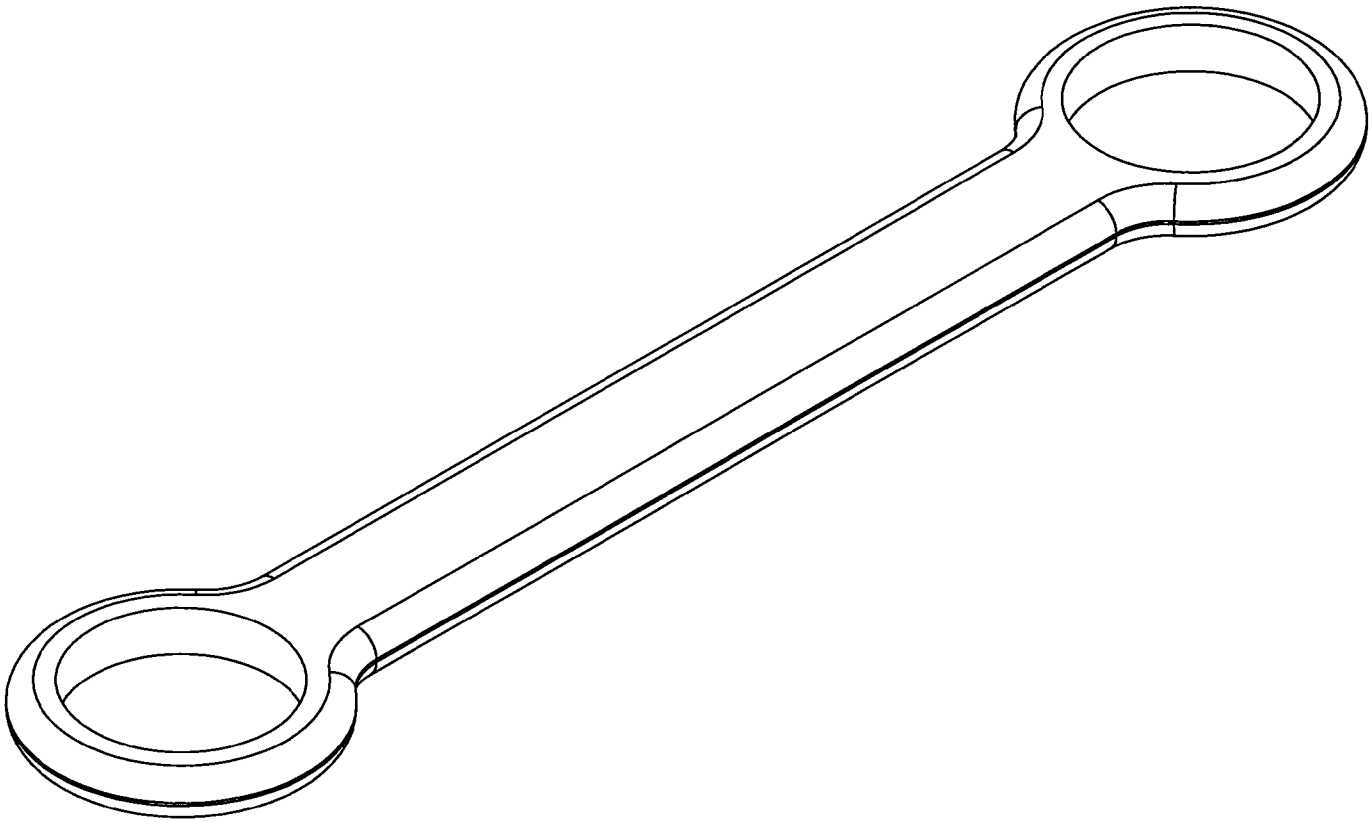
FIG. 16 shows an illuminating footwear accessory loop-clip according to another embodiment.

FIGS. 14-16 shows an illuminating footwear accessory with a flexible clip. The flexible clip has two holes on the ends of the flexible clip within which the illuminating footwear accessory may be placed. The flexible clip may then be fed through parts of a shoe, such as shoelaces, fed through other articles of clothing, such as a belt loop, or clipped to a purse or backpack. FIGS. 14 and 15 show the flexible clip attached to the illuminating light source in two different positions. FIG. 16 shows a three-dimensional view of a flexible clip unattached to an illuminating light source.

Embodiments of the invention may be used on clothing; footwear such as sandals running shoes, work boots, gardening shoes, rubber shoes; accessories such as purses, belts, bags, or backpacks; toys such as bikes, stuffed animals, or dolls; etc.

Another embodiment includes a illuminating light source that includes a rotational switch. Friction may be provided to ensure that the illuminating light source does not rotate when the switch is being activated. Friction may be provided by any number of sources, such as, detents on the exterior of the housing. Friction may also be provided by the material that the illuminating light source is placed within when the illuminating light source is secured in a hole. For example, rubber or leather may provide enough friction such that the illuminating light source does not rotate when illuminating light source is placed in a hole in the shoe while a user is activating a rotational switch. A gasket may also be provided that provides the needed resistance. The illuminating light source may also be placed with a sleeve that provides the proper friction. Moreover the decorative cap may also include detents.

Embodiments of the invention may also include a kinetic energy conversion device that converts motion of the illuminating footwear accessory into energy that can be stored, for example, in a battery or capacitor, and used to illuminate the illumination source. Embodiments of the invention may also include a motion sensor that illuminates the illumination source based on relative motion of the illuminating footwear accessory. Circuitry may also be included that produce flashing lights. Various filters may also be included that create colored light. Colored illumination sources may also be included. Multiple illumination sources may be included with or without multiple colors.

Another embodiment may include a battery operated LED light element, a housing which holds the LED light element, and an elongated, U-shaped clasp which holds the housing. The LED light element may also include an interchangeable cap with a decorative design, which may attach compressively onto top of LED light element or the housing. The LED light element may be secured inside of housing by compressive snap fit. The housing may include an upper and lower housing. The upper housing and lower housing may be coupled with a snap fit or may be threaded together. The snap fit or the threaded screw may also be a switch which completes a circuit that turns the LED light element on or off.

The battery operated LED light element may be turned on and off using a switch activated by a rotating motion. For the purpose of securing the switch in either the on or off position, the housing may include raised wedges which may provide friction against a shoe or other clothing article. The friction may prevent the LED light element from rotating within the shoe when the user is trying to turn the switch and illuminate the LED.

The decorative cap may be secured to the battery operated LED light element by a compressive snap fit. Unwanted rotation between the decorative cap and the battery operated LED light element may be prevented by raised wedges on the interior surface of the decorative cap. Unwanted rotation between the holes of the elongated U-shaped clasp and the housing may be prevented by raised wedges on the interior surface of the holes within an elongated U-shaped clasp.

Figure 17:
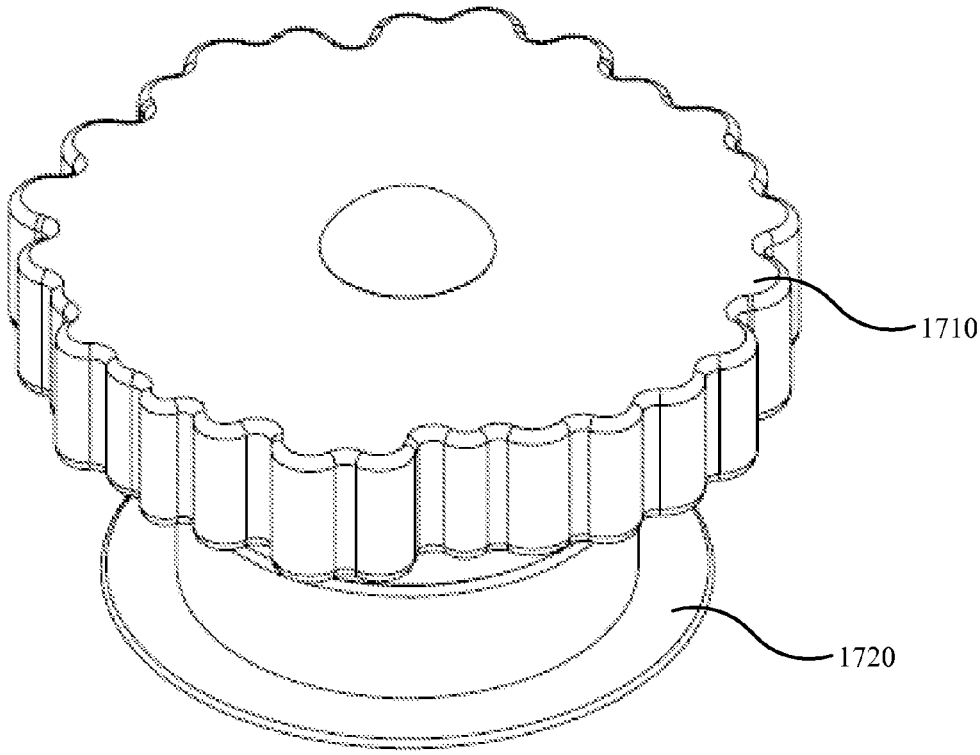
FIG. 17 shows a removable decorative cap on an illuminating footwear accessory according to another embodiment.
Figure 17:
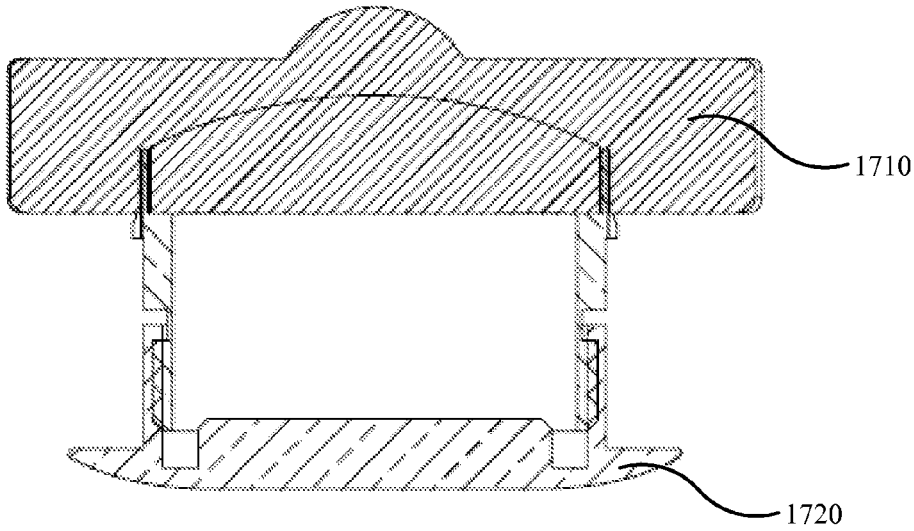

FIG. 17 shows a decorative cap 1710 coupled to an illumination source 1730 according to another embodiment, in this embodiment the illumination source may not include a housing. A flange 1720 may be coupled to the lower portion of the illumination source 1730. A rotational or pressure switch may be included within the illumination source 1730. The illumination source 1730 may also include batteries and, for example, an LED.

Another embodiment may include a housing that includes an upper housing and a lower housing. The interior of the two housings when screwed together snuggly secure a battery or batteries within the housing. The upper housing may also include an illumination source. When the upper housing and lower housing are tightly screwed together a circuit is formed with the batteries and the illumination source turning the illumination source on. When the upper housing and the lower housing are unscrewed the circuit is broken and the illumination source is turned off. The upper and lower housings may only need to be unscrewed a quarter of a turn relative to each other in order to break the circuit. In other embodiments a half turn, three-quarters of a turn, a full turn or combinations of the same may break the circuit. The lower housing and upper housing may include molded plastic or a metal, such as, for example brass and the two housings may be comprised of different material. The upper housing and/or lower housing may include interfering threads that provide friction when turned.

The elongated U-shaped clasp's shape may be used to attach the light element to, for example, laces and tab-like closures such as Velcro.

Figure 18:
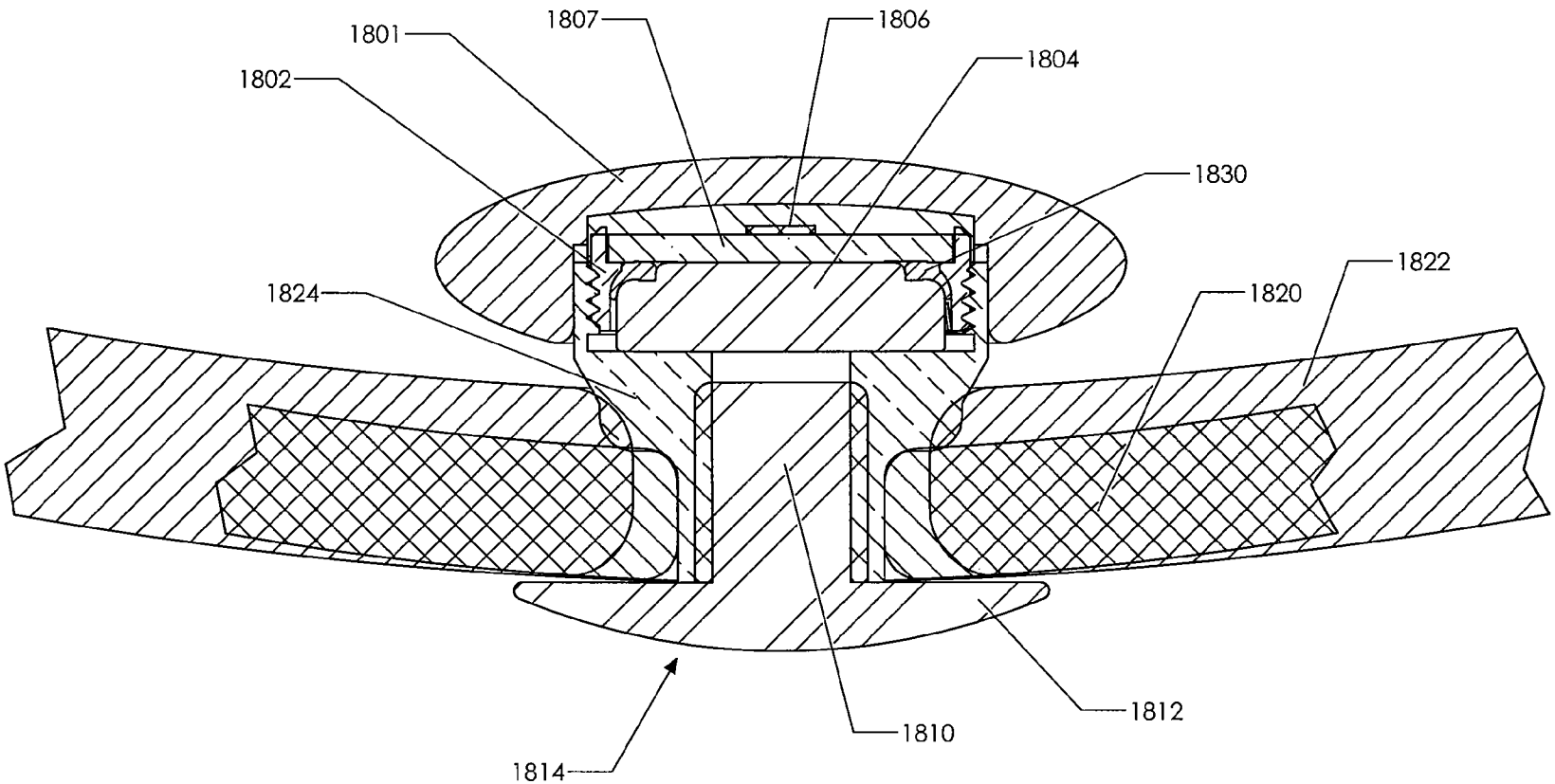
FIG. 18 shows a single battery illuminating footwear accessory attached through an article of footwear according to another embodiment.

FIG. 18 shows a single battery illuminating footwear accessory attached through an article of footwear 1820, 1822 according to another embodiment. In this embodiment a single battery 1804 is used to power the led 1806. The battery 1804 is contained in the upper housing 1802 along with an LED 1806. The LED 1806 being attached to a PCB 1807. The attachment device 1814 includes a stem 1810 and a flange 1812. The stem 1810 couples the attachment device 1814 and the lower housing 1824 and may include friction members or detents. Moreover, the stem 1810 may extend through an article of footwear. The housing comprises an upper housing 1802 and a lower housing 1824. The lower housing 1824 may comprise two distinct outer diameters as shown in the figure. For example, the larger diameter may be sized to slide into presized holes within an upper of an adult's footwear article 1822 while the smaller diameter 1822 may be sized to slide into presized holes within the upper of a child's footwear article 1820. Both diameters may prevent rotation and/or movement within the article of footwear with friction, detents or the like. The lower housing 1824 may also comprise a nonmetallic and/or nonconductive material, such as, for example plastic according to another embodiment. The lower housing 1824 may also comprise a conductive material such as copper or zinc. The lower housing 1824 may also be hollow according to another embodiment.

The decorative cap 1801 may include detents or frictional members on the interior diameter that is in contact with the lower housing 1824. In order to make an electrical circuit between the LED 1806 and the battery 1804; the battery must be in electrical contact with the top of the battery and a battery contact on the bottom surface of the PCB 1807. The contact or contacts close a circuit. Assuming the battery is charged, provide power from the battery to illuminate the LED. Electrical contact may be made by screwing the lower housing 1824 into the top housing 1802. In order to prevent inadvertent tightening and/or loosening between the decorative cover and the bottom housing, detents or frictional members may be included on the inner surface of the decorative cap 1801 in order prevent random loosening or tightening of the decorative cap with respect to the top and the lower housing. The detents or frictional members may also be on the outer surface of the lower housing 1824. Providing friction between the lower housing 1824 and the decorative cap 1801 may restrict random rotation of the decorative cap 1801.

The attachment device 1814 may be screwed into the lower housing 1824. In another embodiment, the attachment device 1814 may be press fit into he lower housing 1824. In another embodiment, the attachment device 1814, being made of plastic, may be heat staked into the bottom housing.

Figure 19:
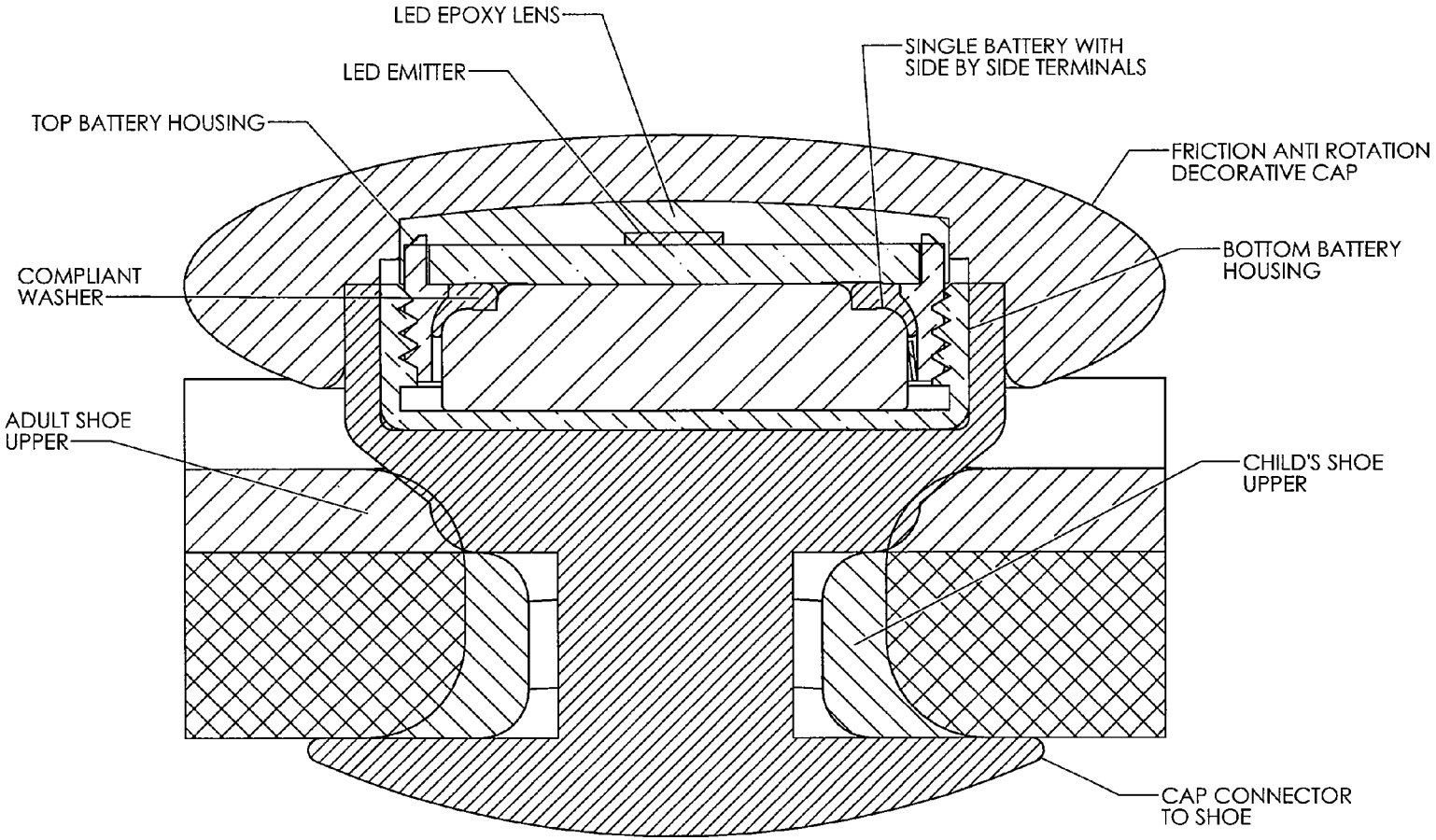
FIG. 19 shows another single battery illuminating footwear accessory according to another embodiment.

FIG. 19 shows a single battery illuminating footwear accessory according to another embodiment. This embodiment includes top and bottom housings. The top housing may be in contact with the bottom surface of the PCB. In some embodiments a PCB with the LED may comprise the top of the top housing. The battery may be in electrical contact with an LED when the top housing is twisted in a certain position and electrical contact is made with a battery. The upper housing may further include an LED lens and/or a decorative cover that may or may not comprise a single part of the upper housing. The decorative cover (or decorative cap) may also provide anti rotation friction, such that, when the illuminating footwear article is placed within a hole in an article of footwear, the anti rotation friction may restrict the illuminating footwear article from rotating within the hole in the footwear article or resist portions of the illuminating footwear article from rotating in respect to each other. The housing may be magnetically coupled with a cap connector through a shoe.

The top housing may also close an electrical connection between the battery and the LED. In various embodiments a stem may couple the housing to the cap connector.

The top housing may also close an electrical connection between the battery and the LED. This, this electrical connection may be broken by unscrewing the upper housing along with a decorative cover, into another portion of the device, such as the lower housing or by clicking a portion of the upper housing into the lower housing. Such screwing or clicking action may physically move the top housing or other battery contact to and from the contacts of the battery and thus closing and opening the electrical connection and therefore providing power to the LED from the battery. The top housing may be screwed with the bottom housing with threads on both the top housing and the bottom housing.

The top housing may also include side-by-side terminals according to one embodiment. Some batteries may provide a terminal at the top of the battery and a return terminal about most of the rest of the surface of the battery. In such embodiments, the upper housing may also include side-by-side terminals that make electrical contact with the side of a battery. These terminals may extend vertically in such a way as to provide a closed loop electrical circuit when a portion of the upper housing is either clicked or screwed into another portion of the upper housing. A compliant washer may provide the necessary contact between a conductive path of the top housing and the side-by-side terminals. The compliant washer may include a spring or lever mechanism that provides an open electrical connection in one configuration and a closed electrical connection in a second configuration.

In another embodiment, the top housing and the bottom housing may provide one or more conductive pathway from a battery to the LED in another embodiment. The housings may comprise a conductive material and/or the housings may include a conductor to provide an electrical connection.

In another embodiment, a battery with side-by-side positive and negative battery contacts may be used. In such an embodiment, the battery contacts are exclusively on the side of the battery within the housing. In such an embodiment, the conductive contacts may be placed on the side of the battery within the housing. In yet another embodiment, the top and bottom housing may be comprised of a nonconductive material, such as, for example, plastic, fiberglass, resin, etc.

The top housing or another portion of the upper housing may include concentric conductive rings that contact corresponding electrical contacts on the top surface of the battery. These concentric metallic rings may be located between an insulator(s). Each of the concentric circles may be electrically coupled to a lead of the LED. Moreover, clicking and/or screwing a portion of the top housing may close or open the connection between the battery and LED through these concentric circles. In other embodiments of the invention, the top housing may include other non-concentric circle contacts that provide an electrical connection between the battery and the LED.

The battery, in this embodiment, may be removed and/or replaced. The top housing maybe unscrewed or uncapped providing access to the battery.

The illuminating footwear article in FIG. 18 may also include a cap connector or attachment device according to one embodiment. The attachment device may be connected, coupled, secured, screwed, clicked, clipped, magnetized etc. into or onto the housing. The attachment device may also include a flange and a stem. The stem may include detents or frictional members that are in contact with the footwear member. The flange may be heat staked in place in the lower housing module. These detents or frictional members may keep the illuminating footwear article from rotating when inserted through an article of footwear. The flange may be sized with a diameter that is larger than an adult and/or child sized hole in an upper of an article of footwear. The stem may also include an additional buffer ring and/or washer to provide increased friction and/or size. Increasing the size with a ring or washer may allow a stem sized for a hole in the upper of a child's footwear article to properly fit into the hole of an upper of an adult's article of footwear.

Figure 20:
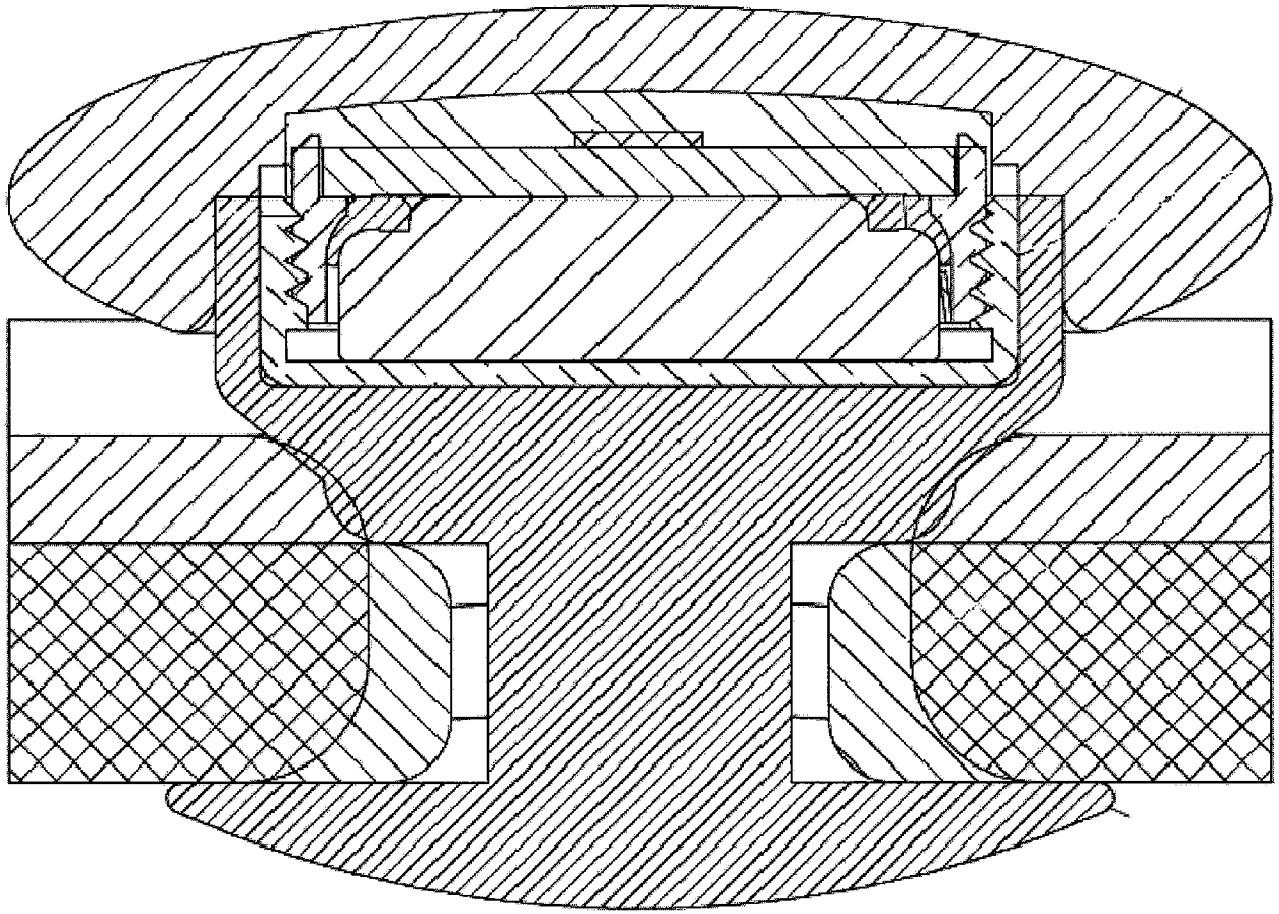
FIG. 20 shows another single battery illuminating footwear accessory according to another embodiment.

FIG. 20 shows an enlarged view of the single battery illuminating footwear accessory shown in FIG. 19 according to another embodiment.

Figure 21:
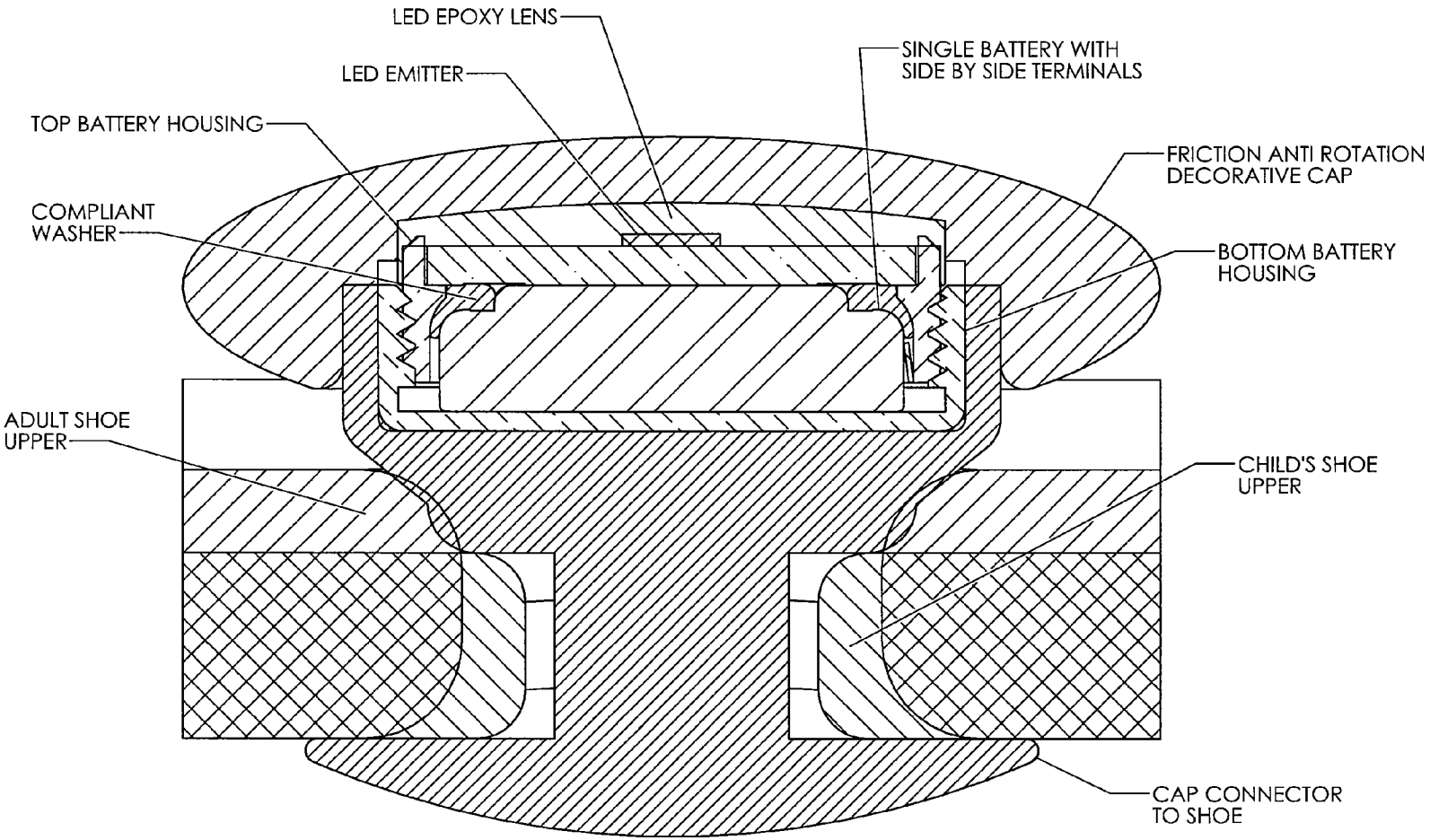
FIG. 21 shows yet another single battery illuminating footwear accessory according to another embodiment.

FIG. 21 shows yet another single battery illuminating footwear accessory according to another embodiment. In this embodiment the bottom housing (cap connector) includes a flange (cap connector to shoe), and a stem that extends from the flange and, when in use, up through a hole in an article of footwear. The lower housing may comprise a volume that may contain the bottom housing and the battery as shown. The lower housing may comprise a metal and/or a plastic or other nonconductive and/or synthetic material. The decorative cover may overlap the lower housing and may be in contact with the top surface of a shoe. The decorative cap may also include frictional members that may contact the shoe upper and/or the lower housing. These frictional members may provide positive resistance from random motion that may rotate the decorative cap from the bottom housing and either break or create a circuit between the battery and the LED.

FIG. 21 also shows the stem comprises thicknesses of two diameters. The smaller diameter may be sized in order to slide the stem through a hole in the upper of a child's footwear article. The larger diameter may be sized in order to slide the stem through a hole in the upper of an adult's footwear article. As shown in the figure, in some cases the upper of a child's footwear article may be thinner than the upper of an adult footwear article. Accordingly, the smaller diameter of the stem may only extend along a longitudinal portion of the stem that is as thick as thickness of the upper of a child's footwear article. These two diameters may be thought of as a two step retention device which accommodates holes of different diameters and materials of different thicknesses.

In another embodiment, the decorative cover extends over the lower housing. This extension may provide a frictional surface that resists rotational forces on the illuminating footwear article. In some embodiments, the extension may provide friction between the decorative cover and the top surface of the article of footwear. The decorative cover may also be attached with a PCB that provides circuitry and mounting for the LED. The decorative cap may be glued, taped, welded, soldered, snapped, etc. to the PCB according to another embodiment. The decorative cover may also be over-caste or over-molded to provide attachment point(s) to the PCB according to another embodiment. The decorative cover may also include a reservoir around the inner circumference to accommodate excessive adhesive, such as, for example, glue, tape, solder, welding material, etc.

Figure 22:
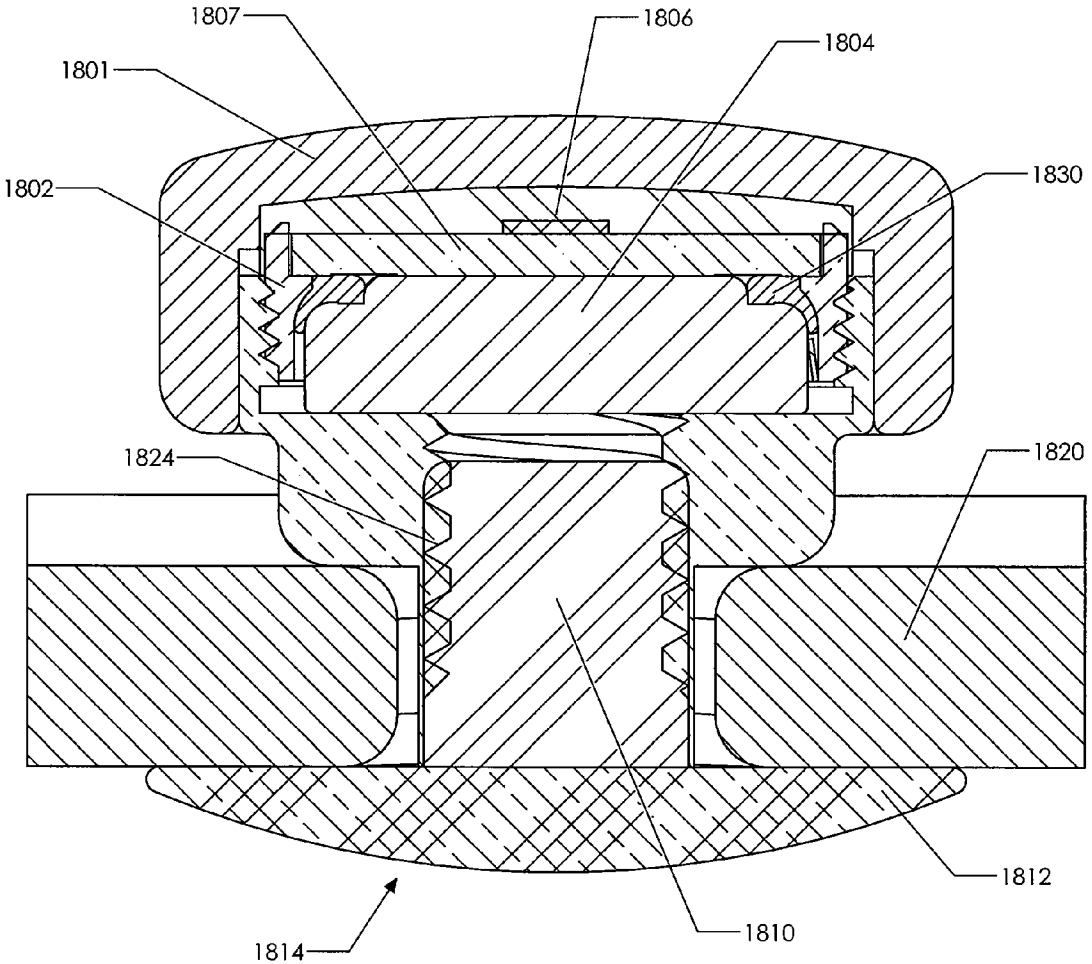
FIG. 22 shows yet another single battery illuminating footwear accessory according to another embodiment.

FIG. 22 shows yet another single battery illuminating footwear accessory according to another embodiment. According to this embodiment, the attachment device 1824 comprises a plastic or synthetic material. The attachment device may also include threads. These threads may be used to attach the bottom housing 1824 to the attachment device 1814. In another embodiment, the attachment device 1824 may initially comprise four flat sides and may not comprise threads. In other embodiments the stem comprises 2, 3, 5 or 6 sides. Threads may be cut into the attachment device 1814 using the lower housing 1824 to cut the threads. The shape and of the lower housing 1824 may shift and change overtime. The misshapen behavior of the lower housing 1824, may provide extra fiction between the lower housing 1814 and the attachment device 1824. The device also includes a side-by-side battery 1830.

Figure 23:
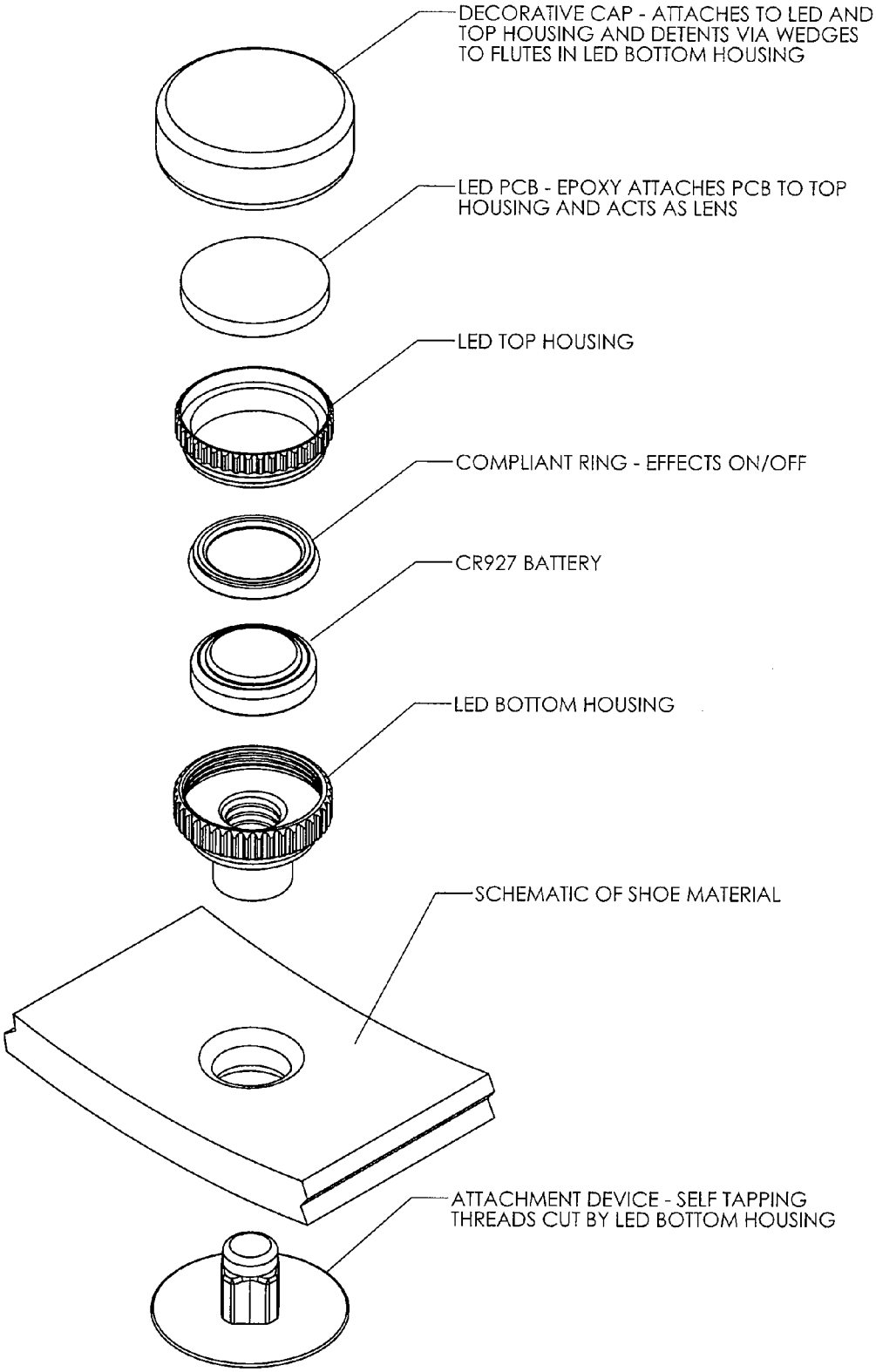
FIG. 23 shows various components of another single battery illuminating footwear accessory according to another embodiment.

FIG. 23 shows an expanded view of various components of another single battery illuminating footwear accessory according to another embodiment. The attachment device is shown with four flat sides and is self tapping using threads from the metallic bottom housing.

Various embodiments of the invention show an illumination device employing only a single battery. Those skilled in the art reject the premise that a single battery device is usable. They suggest that a single battery does not provide enough power for long enough to illuminate an LED. Some devices, for example, may contain a single LED but these devices are limited to illumination devices that blink. However, based on the embodiments of the invention, a single battery device is useable. The single battery may be a CR927 battery. The battery may have a diameter of 9.5 mm and a height of 2.7 mm. Other batteries of various sizes and our configurations may be used for embodiments of the invention.

Figure 24:
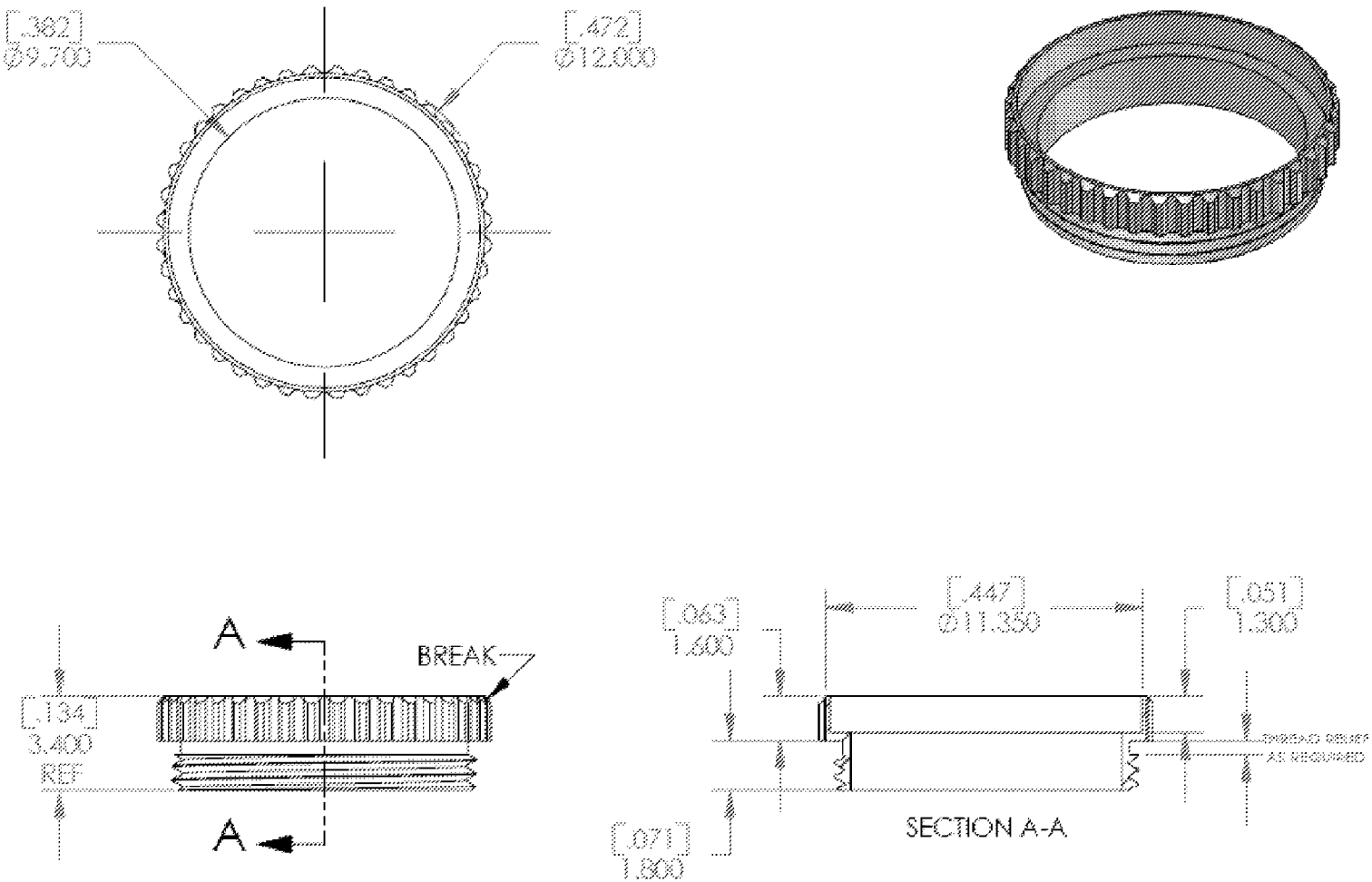
FIG. 24 shows various views of an LED top housing according to another embodiment.

FIG. 24 shows various views of a top housing according to another embodiment. Portions of the outer surface of the top housing may comprise detents as shown. In an alternate embodiment, the PCB is smaller in diameter than as is shown. in the figures. This smaller diameter enables a lower overall height for the light module. Low height enables the decorations to be much lower or thinner and more attractive in certain decorations styles.

Figure 25:
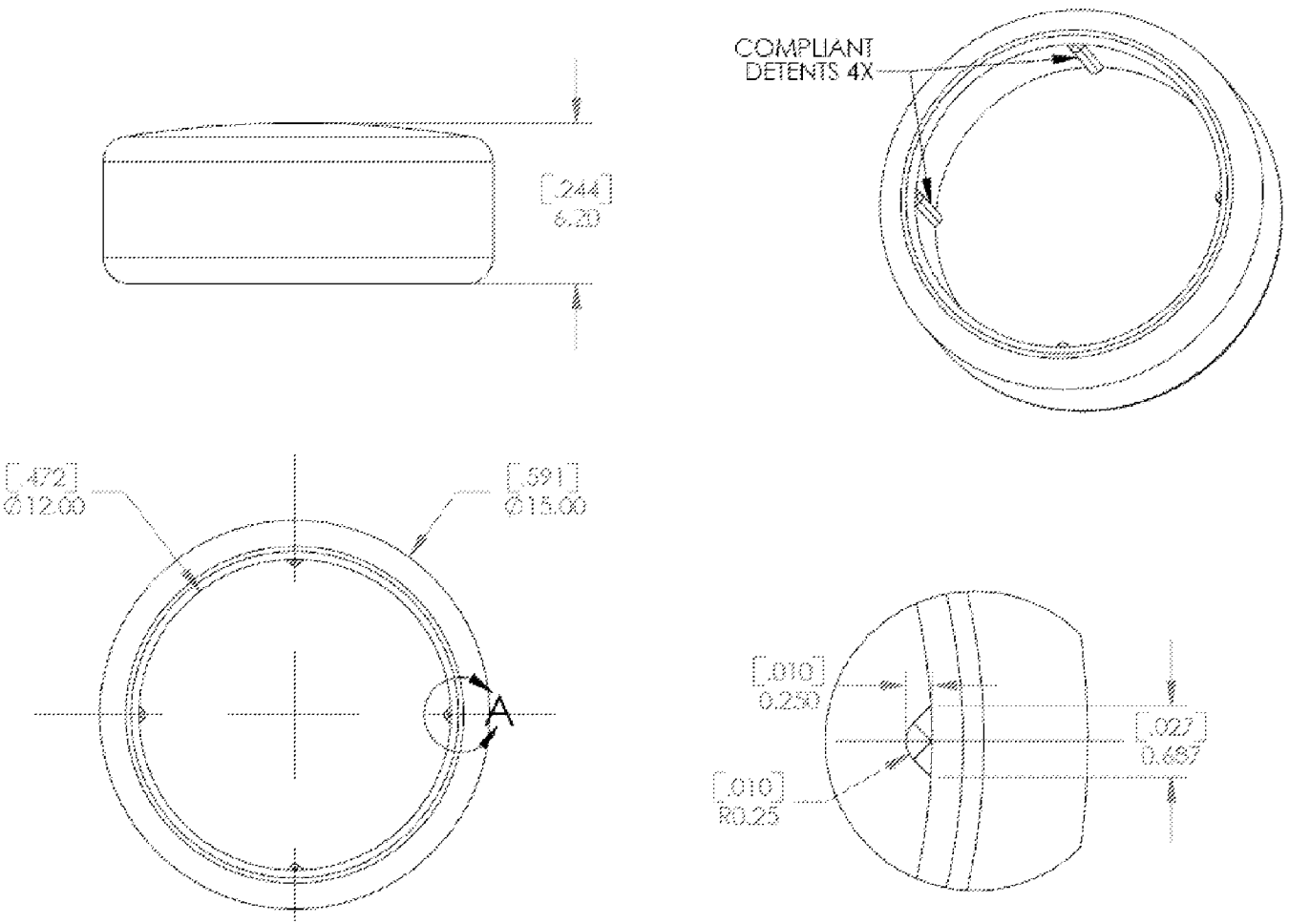
FIG. 25 shows the decorative cover according to another embodiment.

FIG. 25 shows a decorative cover according to another embodiment. The inner surface of a decorative cover may include detents. While four detents are shown, any number of detents may be used. These detents may contact the housing (either upper or lower depending on the embodiment) and provide friction between the housing and the decorative cover to mitigate random rotational motion by providing enough positive resistance. In an alternate embodiment the PCB is smaller in diameter. This enables a lower overall height for the light module. Low height enables the decorations to be much lower or thinner.

Figure 26:
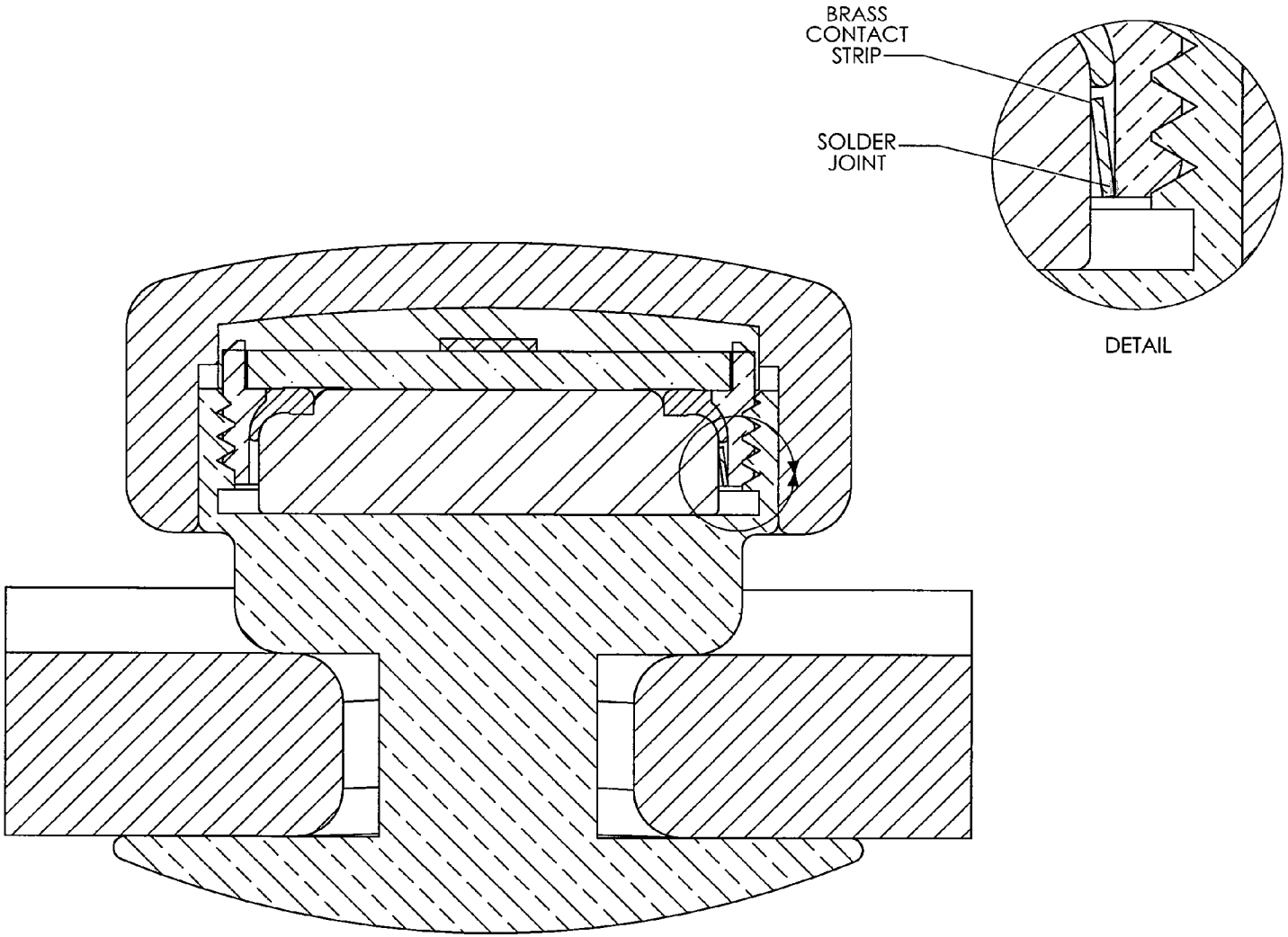
FIG. 26 shows yet another single battery illuminating footwear accessory and detailing side-by-side battery contacts according to another embodiment.

FIG. 26 shows yet another single battery illuminating footwear accessory and detailing side-by-side battery contacts according to another embodiment. The detail in the figure shows one embodiment using a contact strip to make contact with the side of a battery. The contact strip may be made of any conductive material, such as, for example, brass. The contact strip must include some spring in order to press against the side of the battery. Various other configurations may be used to make a side-by-side contact with the battery.

Figure 27:
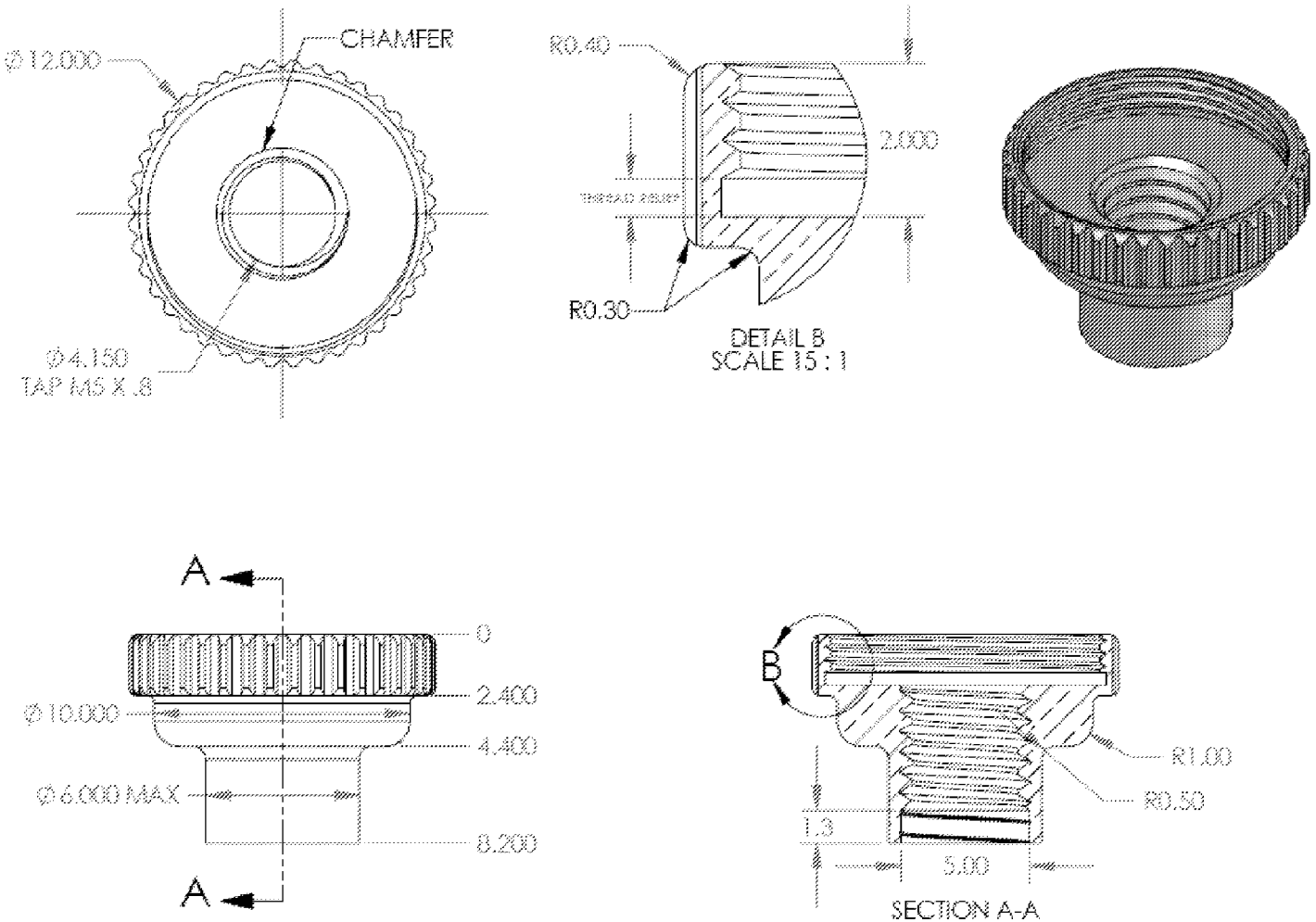
FIG. 27 shows various views of a bottom housing according to another embodiment.

FIG. 27 shows various views of a bottom housing according to another embodiment. The bottom housing may include a cup like shape that may hold a battery. The bottom housing may also include a stem. Detents on an outer surface may also be included. Moreover, the diameter of the bottom housing may comprise a plurality of diameters such that the stem may securely fit within a hole in a shoe or other footwear article. The bottom housing may also include threading that may be used to couple to an attachment device. These threads may be used to tap the stem of an attachment device. The attachment device may also be heat staked in place.

The top and bottom housings may be connected using threading, snapping, gluing and/or press fitting or a combination of the above. Similarly, the housing may be connected to the attachment device using threading, snapping, gluing, heat staking and/or press fitting.

Moreover, the top housing and/or the bottom housing may comprise a conductive material such as brass or nonconductive material such as plastic. In some plastic embodiments, a conductive strip may be included in order to conduct power from the battery to the LED. In some embodiments the conductive strip may contact the side of a battery. In other embodiments the conductive strip may contact the battery along the bottom of the housing.

Figure 28:
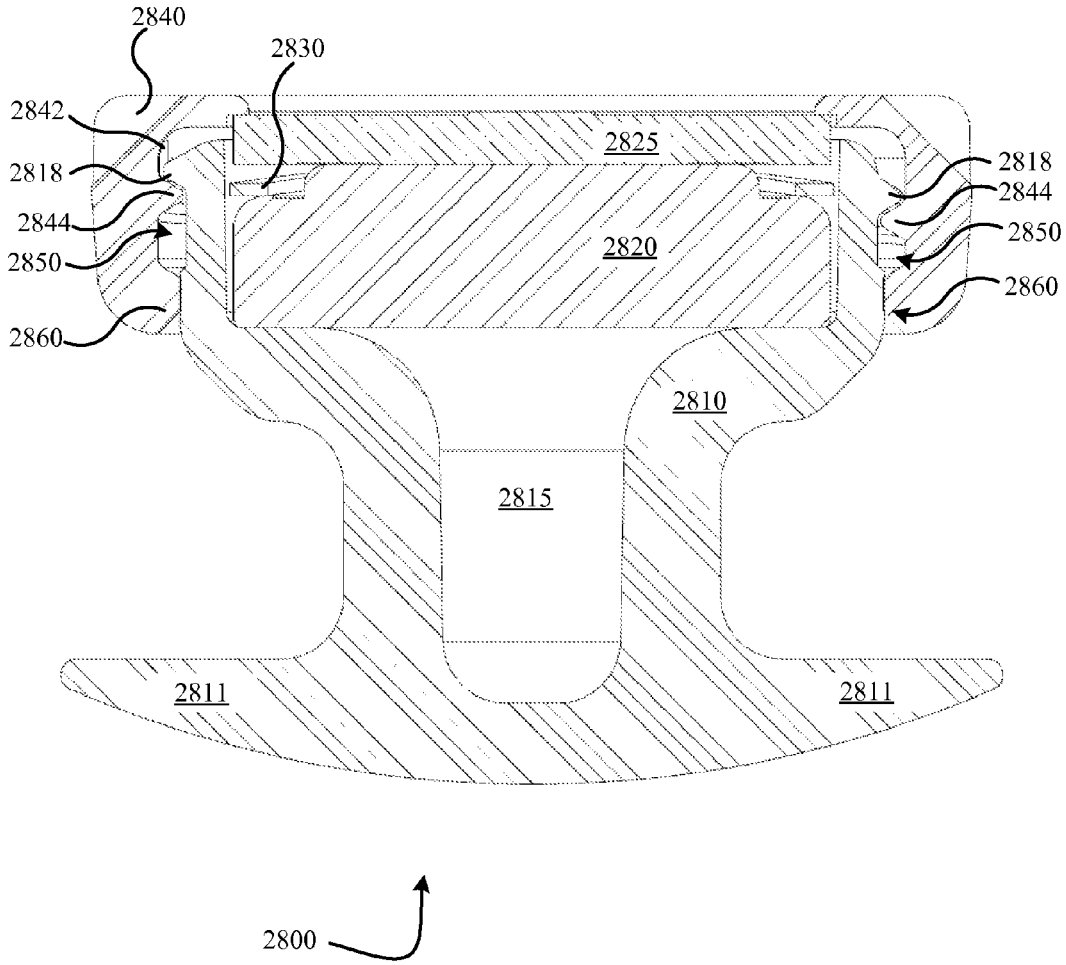
FIG. 28 shows a side view of another customized light module housing according to one embodiment.

FIG. 28 shows a side view of another customized light module 2800 housing according to one embodiment. FIG. 28 shows the light module in the "on" position. A bottom housing 2810 and a top housing 2840 are coupled together using a two-stage mechanism. The bottom housing 2810 includes a flange 2811 adapted to couple the customized light module within an aperture of an article of foot wear, for example, within the hole of a rubber clog. The bottom housing may also include a hollow interior 2815. A battery 2820 and PCB 2825 are held within the bottom housing as shown. A conductive washer 2830, such as, for example, a wave washer 2830 (see FIGS. 33A, 33B, 33C and 33D) is shown. The washer 2830 may provide a current path between the battery 2820 and the PCB 2825 when the bottom housing 2810 is situated in the on position relative to the top housing. As shown, coupling the top housing 2840 with the bottom housing 2810, secures the battery 2820 and PCB 2825 within coupled top housing 2840 and bottom housing 2810. The top housing 2840 and bottom housing 2810 may comprise a plastic material, or another nonconductive material according to one embodiment. In other embodiments, the housing may comprise any other material.

The two stage mechanism, according to one embodiment, includes a threading mechanism and snapping mechanism. A two stage mechanism provides childproof security and may prevent a child from opening the light module. In other embodiments a single or other multiple stage coupling mechanism may be used as a childproof mechanism to prevent easy access to a battery 2820. As shown in FIG. 28, the top housing includes a detent 2842 and a thread 2844. The bottom housing 2810 also includes a thread 2818. While only a single thread on the top housing 2840 and the bottom housing 2810 are shown, multiple threads may be used. The threads on the top housing 2840 and the bottom housing 2810 provide a first stage coupling mechanism. The top housing also includes a snap ridge 2860. The thread 2818 on the bottom housing 2810 may engage with the snap ridge 2860 to provide a second stage coupling mechanism. The snap ridge 2860 may comprise a ridge of between about 0.001 to 0.010 inches. Thus, according to one embodiment, in order to remove the top housing 2840 from the bottom housing 2810, the top housing 2840 may be unthreaded from the bottom housing 2810 and unsnapped from the bottom housing.

Accordingly, the battery is secured within the housing combination using a two-stage mechanism. A gap 2850 between the first and second couple mechanisms may also be provided.

Figure 29:
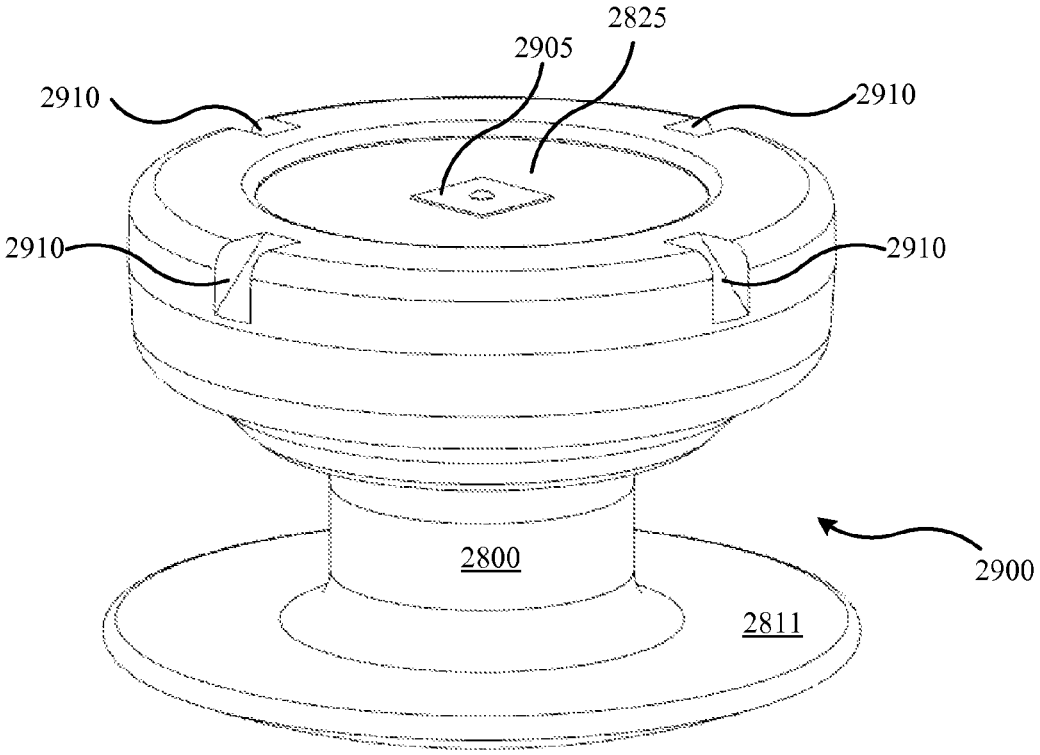
FIG. 29 shows perspective view of a customized light module according to another embodiment.

FIGS. 28 and 29 show a bottom housing 2810 secured with a top housing 2840 according to one embodiment. In FIG. 29, a PCB 2825 with an LED 2905 is shown. The detent 2842 in the top housing 2840 may limit the extent of the threading engagement, and thus, limit the position of rotation within a specific region, the "on/off" and "safe" positions. After forcibly snapping the top housing snap ridge 2860 and bottom housing threads 2810 together, placing the threads in initial unengaged contact, the top housing is rotated with respect to the bottom housing, engaging the threads, until the detents make initial contact. The top and bottom housings may then be forcibly rotated one to the other until the detent 2842 over rides the detent edge 3110 (on FIG. 31). Once retained within this region, the top housing 2840 can be rotated to turn the light "on" and counter rotated, arriving back at the detent, turning the light again "off". The "off" position detent also provides that the light module parts will not randomly further unwind and become unthreaded.

Figure 30:
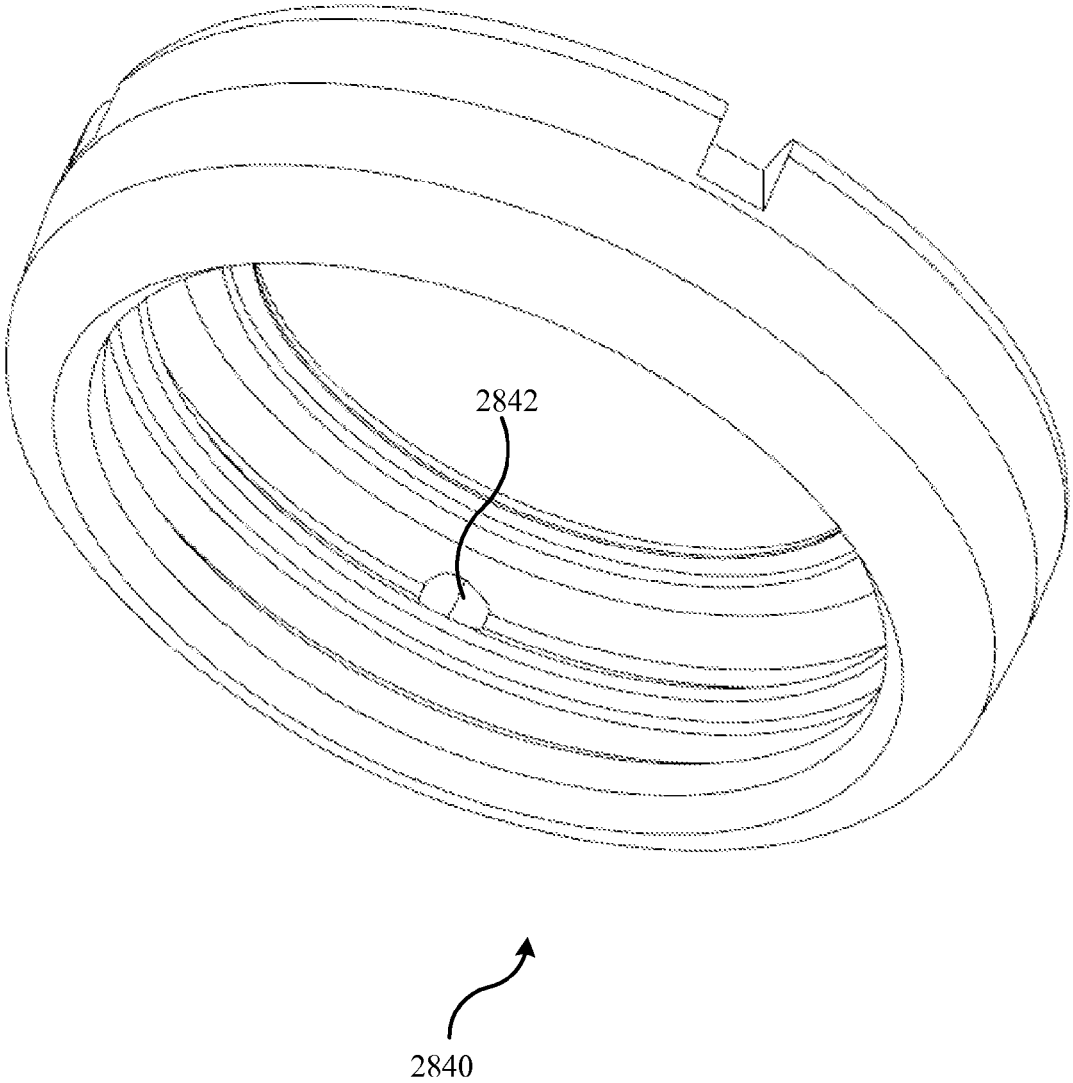
FIG. 30 shows a perspective view of a top portion of a customized light module according to one embodiment.

FIG. 30 shows a perspective view of a top housing 2840 showing a male detent 2842. The male detent 2842, when the top housing is secured with the bottom housing, limits rotation within the on/off and/or safe region. That is, the male detent 2842, when engaged between the two detent ridges in the bottom housing 2810 (on FIG. 31), limits any random unwinding of the top housing. The rotation of the top housing relative to the bottom housing is limited due to the detents. Thus, in this embodiment, the top housing 2840 may be rotated relative to the bottom housing 2810 in order to turn a light source "on" or "off", and the top housing may be restricted from coming unscrewed and apart under normal forces. One may force the top housing past the detents, but doing so may require forced beyond accidental forces or beyond forces capable of being applied by children. Thus, the top housing may not easily be removed from the bottom housing.

Figure 31:
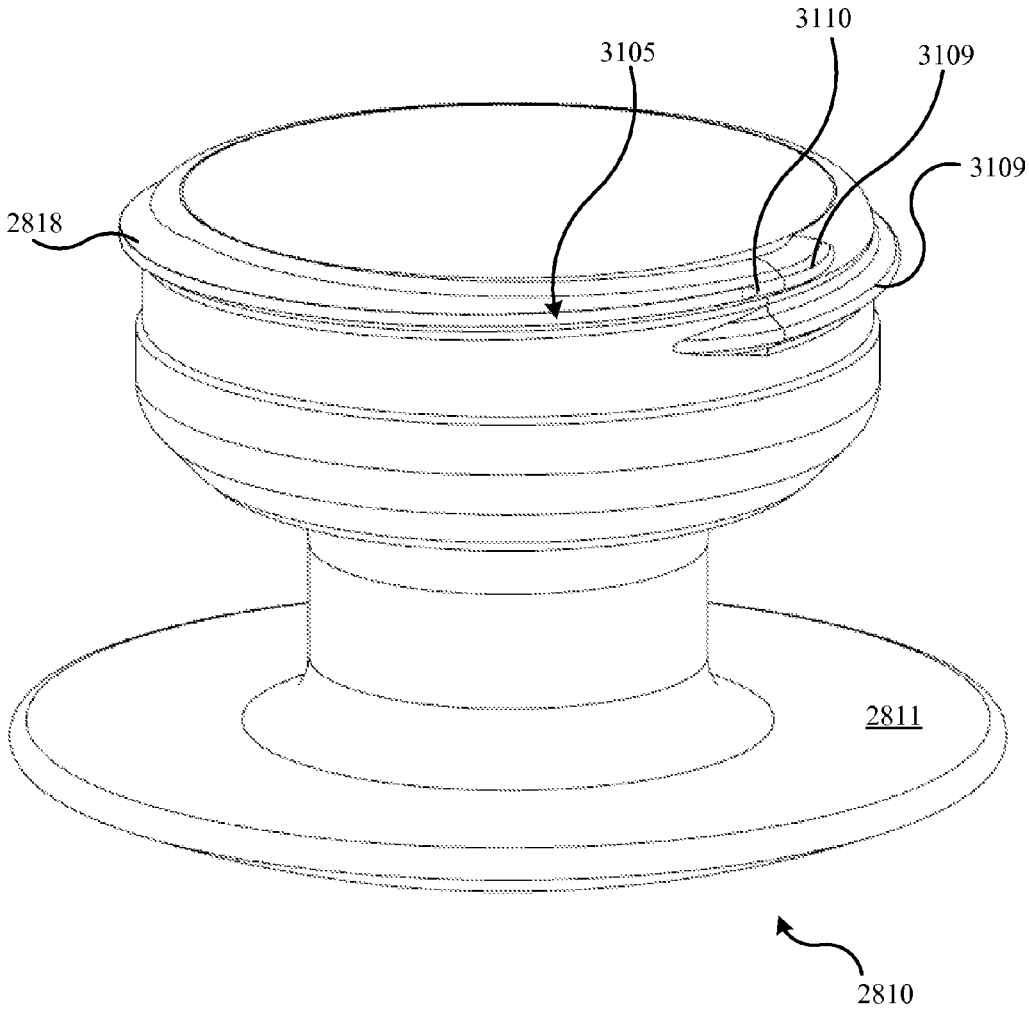
FIG. 31 shows a perspective view of a bottom portion of a customized light module according to one embodiment.
Figure 32:
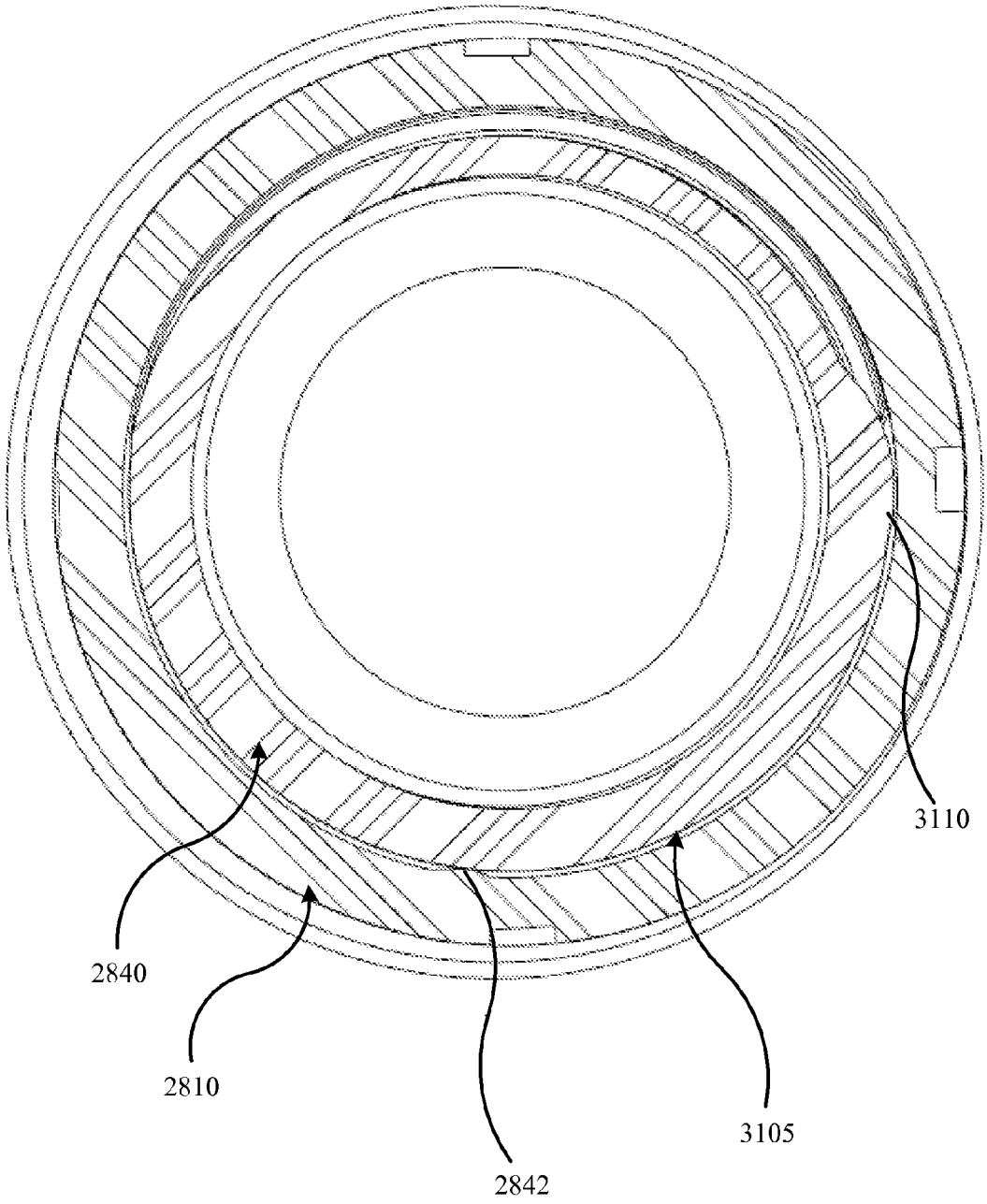
FIG. 32 shows a section view of a top housing coupled with a bottom housing according to one embodiment.

FIG. 31 shows a perspective view of a bottom housing 2810 according to one embodiment and FIG. 32 shows a section view of a combined top and bottom housing. Referring to both figures, a female detent 3105 is a recess in a portion of the thread 2818. The beginning of the female detent 3110 acts as a male detent. The female detent 3105 may continue for about 180° in one embodiment. In other embodiments, the female detent 3105 may continue through about 90° to 270° of the bottom housing. The bottom housing 2810 may thread with the top housing 2840 as the detent does not oppose the motion until the detent 2842 comes into contact with the full thread area 3109. The male detent 2842 in the top housing forcibly passes over the full thread area 3109 and enters the recess 3105. Once the detent 2842 has passed into 3105, the detent allows further, unrestricted threading only within the recessed area.

Figure 34:
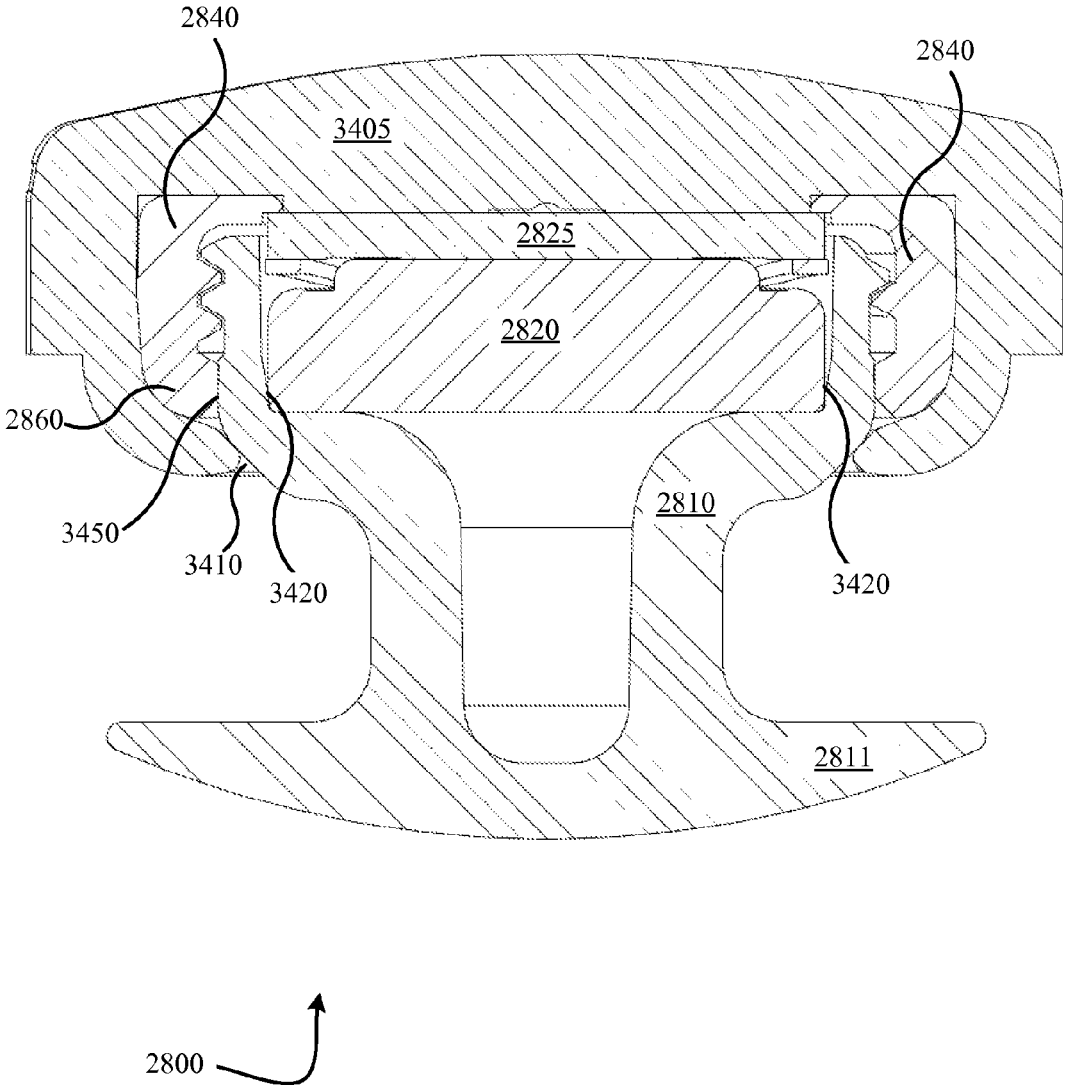
FIG. 34 shows a customized light module with a decorative cap according to one embodiment.

In FIGS. 28-32, according to various embodiments described herein, a decorative cap 3405 may be permanently or removably secured on the housing as shown in FIG. 34. The decorative cap 3405 may create or be coupled with a seal 3410 that provides protection from such things as water, dust, sand, and/or grit. In some embodiments, the seal is water proof and/or water resistant. In other embodiments the seal may include a feathered tip. In yet other embodiments the seal may include a rubber washer or the like. In another embodiment, a seal may also be provided between the non-threaded region of the bottom housing 3450 and the snap ridge 2860 of the top housing 2840.

FIGS. 33A, 33B, 33C and 33D show views of an electrically conductive wave washer 2830 according to one embodiment. A wave washer 2830 may be used as shown in FIG. 28 as a contact between a battery and a PCB and/or LED. A wave washer 2830 may or may not have tabs 3305 as shown. Tabs 3305 may be used to position the wave washer 2830 relative to the battery. In other embodiments, the washer may be glued, soldered or welded in place. The wave washer 2830 includes waves 3310. The washer 2830 shown in FIG. 28 may be a wave washer 2830. Using a wave washer 2830 or the like, may allow a circuit to form between the battery and the PCB board when the top housing is twisted within the detents in the bottom housing, bringing the battery top terminal into contact with the bottom terminal of the PCB. In some embodiments, at least a portion of the wave washer is always in contact with the side and/or bottom terminal of the battery. The circuit may be opened when the bottom housing is rotated away from the top housing. The rotation allows for the creation of a space between the battery and the bottom of the PCB. The wave washer 2830 pushes the battery away from PCB, opening the circuit.

In some embodiments of the invention, a tool may be used to detach the top housing from the bottom housing. In another embodiment of the invention, as shown in FIG. 34, the bottom housing includes a cavity for securing the battery that has wedge-shaped walls 3420 such that the battery 2820 may be wedged within the housing to secure the battery 2820 within the housing. Such an embodiment may provide another level of child safety in that the battery 2820 is not easily removable.

In another embodiment, a single shaped ridge in the side wall may be used to wedge the battery within the bottom housing 2810. In other embodiments, multiple wedges may be used. The battery may be removed by squeezing the sides of the bottom housing. Such squeezing may create a gap allowing the battery to fall out. Embodiments with ridges that require squeezing to remove a battery may incorporate one example of a child-lock system.

Figure 35:
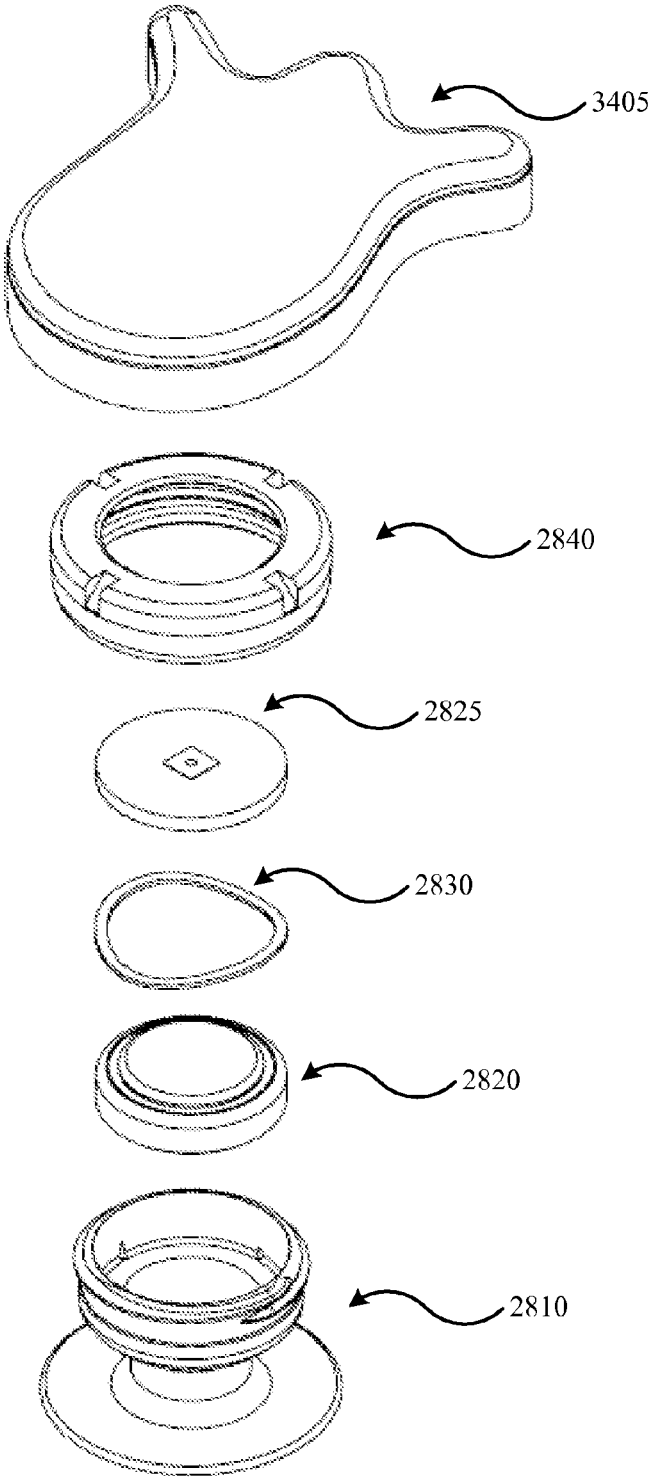
FIG. 35 shows an exploded view of a customized light module according to one embodiment.

FIG. 35 shows an exploded view of a customized light module according to one embodiment. From bottom to top, a bottom housing 2810, a battery 2820, a wave washer 2830, a PCB 2825, a top housing 2840, and a decorative cap 3405 are shown. The decorative cap may comprise any shape and/or color. The decorative cap may also include various three dimensional features.

According to another embodiment of the invention, the battery may be secured in the top housing. In such an embodiment, the battery may be secured using a childproof mechanism, such as, for example, a two stage mechanism. The two-stage mechanism, for example, may include a threaded mechanism and a snap mechanism. In another embodiment, the childproof mechanism may include a push and turn mechanism and/or a squeeze and turn mechanism. Various other childproof mechanisms may also be used. In yet another embodiment of the invention, the battery may be contained within a single housing. The single housing may include a cavity within which the battery may be secured.

What is claimed is:

1. A customized light module comprising:

a first housing, wherein the first housing comprises a stem that is configured to secure the customized light module within an aperture of an article of clothing;

a light source coupled with the housing;

a second housing removably coupled with the first housing and configured to illuminate when the light source is illuminating, wherein both the first housing and the second housing comprise threads such that the first housing and the second housing configured to couple together using the threads, and wherein either or both the second housing and the first housing comprise a detent such that the detent provides friction between the first housing and the second housing during threading to mitigate random rotational motion at a point during threading, wherein once the second housing is threaded past the detent, the housing has at least two configurations: a first configuration and a second configuration, wherein a circuit is open between the battery and the light source in the first configuration, and wherein the circuit is closed between the battery and the light source in the second configuration; and a battery accessibly secured within the housing, wherein the battery is disposed within a cavity defined by the housing and the second housing.

2. The customized light module of claim 1, wherein the first housing and the second housing are configured to transition between the first configuration and the second configuration by threading or unthreading the first housing relative to the second housing.

3. The customized light module of claim 2, further comprising a conductive contact configured to open the circuit between the battery and the light source in the first configuration, and the conductive contact is further configured to close the circuit between the battery and the light source in the second configuration.

4. The customized light module of claim 3, wherein the contact washer comprises a wave shape.

5. The customized light module of claim 2, further comprising a lock mechanism that secures the housing in the first configuration, the second configuration or both configurations.

6. The customized light module of claim 5, wherein the lock mechanism includes the detents.

7. The customized light module of claim 1, wherein the housing comprises plastic.

8. The customized light module of claim 1, wherein the housing comprises a nonconductive material.

9. The customized light module of claim 1, wherein the second housing includes a seal that seals the second housing with the first housing.

10. The customized light module of claim 1, wherein a non threaded outside diameter of the bottom housing forms a seal with the top housing.

11. The customized light module of claim 1, further comprising a decorative cap coupled with either or both the first housing or the second housing.

12. A customized light module comprising:

a housing comprising:

a top portion comprising threads and a detent; and a bottom portion comprising threads and a detent, wherein the top portion and the bottom portion are coupled together using the threads, an attachment mechanism configured to attach the customized light module with either or both an article of clothing or an accessory;

a light source coupled with the housing; and a battery accessibly secured within the housing wherein the battery is disposed within the housing, wherein the threaded combination of the top portion and the bottom portion comprise a three stage mechanism, in the first stage the threads have just been engaged and the detents have not made contact, in the second stage a circuit is not complete between the battery and the light source such that the light source is not illuminates and the second stage ends after the detents make contact and slip past each other during threading, and in the third stage the circuit is closed and the light source is illuminated.

13. The customized light module of claim 12, further comprising a decorative cap coupled with the housing and configured with a decorative pattern.

14. The customized light module of claim 12, wherein the article of clothing comprises a shoe.

15. The customized light module of claim 12, wherein the accessory comprises at least one of a purse, a belt, a bag, or a backpack.

16. The customized light module of claim 12, wherein the attachment mechanism comprises a flexible loop-clip.

* * * * *